US012104594B2

(12) United States Patent
Ignatiev et al.

(10) Patent No.: US 12,104,594 B2
(45) Date of Patent: Oct. 1, 2024

(54) CO-ROTATING COMPRESSOR

(71) Applicant: Copeland LP, Sidney, OH (US)

(72) Inventors: Kirill M. Ignatiev, Sidney, OH (US); Robert C. Stover, Versailles, OH (US); Michael M. Perevozchikov, Tipp City, OH (US); Mikhail A. Antimonov, Beavercreek, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/519,953

(22) Filed: Nov. 5, 2021

(65) Prior Publication Data

US 2023/0147568 A1 May 11, 2023

(51) Int. Cl.

| | |
|---|---|
| ***F04C 18/02*** | (2006.01) |
| ***F04C 29/00*** | (2006.01) |
| ***F04C 29/04*** | (2006.01) |
| ***F04C 29/12*** | (2006.01) |

(52) U.S. Cl.

CPC ..... *F04C 18/023* (2013.01); *F04C 29/005* (2013.01); *F04C 29/045* (2013.01); *F04C 29/12* (2013.01); *F04C 2240/20* (2013.01); *F04C 2240/30* (2013.01); *F04C 2240/52* (2013.01); *F04C 2240/603* (2013.01)

(58) Field of Classification Search

None

See application file for complete search history.

(56) References Cited

U.S. PATENT DOCUMENTS

| | | | |
|---|---|---|---|
| 2,415,011 | A | 1/1947 | Hubacker |
| 2,420,124 | A | 5/1947 | Coulson |
| 2,440,593 | A | 4/1948 | Miller |
| 3,817,664 | A | 6/1974 | Bennett et al. |
| 4,105,374 | A | 8/1978 | Scharf |
| 4,753,582 | A | 6/1988 | Morishita et al. |
| 4,781,550 | A | 11/1988 | Morishita et al. |
| 4,846,639 | A | 7/1989 | Morishita et al. |

(Continued)

FOREIGN PATENT DOCUMENTS

| | | | |
|---|---|---|---|
| CA | 2356534 | A1 | 3/1995 |
| CN | 101080597 | A | 11/2007 |

(Continued)

OTHER PUBLICATIONS

English language translation equivalent for WO-2018116696-A1 is provided in the form of U.S. Appl. No. 11/041,494.

(Continued)

*Primary Examiner* — Wesley G Harris

(57) ABSTRACT

A compressor includes a compression mechanism, a driveshaft, and a motor. The compression mechanism is configured to compress a fluid to a discharge pressure. The motor is configured to rotate the driveshaft. The driveshaft is engaged with the compression mechanism and is fixed to rotate with at least a portion of the compression mechanism. The driveshaft includes a longitudinal aperture configured to receive the fluid at a suction pressure, and includes a flange that receives at least a portion of the compression mechanism. The flange and the compression mechanism define a fluid passage therebetween. The fluid at suction pressure is received within the fluid passage from the longitudinal aperture in the driveshaft.

15 Claims, 14 Drawing Sheets

(56) References Cited

U.S. PATENT DOCUMENTS 4,927,339 A 5/1990 Riffe et al.
4,927,340 A 5/1990 McCullough
4,950,135 A 8/1990 Tojo et al.
5,002,470 A 3/1991 Gormley et al.
5,037,280 A * 8/1991 Nishida ..... F01C 17/066 418/55.3
5,051,075 A 9/1991 Young
5,069,605 A 12/1991 Saitoh et al.
5,073,093 A 12/1991 Takagi et al.
5,082,432 A 1/1992 Kikuchi
5,090,876 A * 2/1992 Hashizume ..... F04C 29/0085 417/410.5
5,099,658 A 3/1992 Utter et al.
5,101,644 A 4/1992 Crum et al.
5,123,818 A 6/1992 Gormley et al.
5,129,798 A 7/1992 Crum et al.
5,141,417 A 8/1992 Bush
5,141,421 A 8/1992 Bush et al.
5,142,885 A 9/1992 Utter et al.
5,149,255 A 9/1992 Young
5,178,526 A 1/1993 Galante et al.
5,199,280 A 4/1993 Riffe et al.
5,211,031 A 5/1993 Murayama et al.
5,242,284 A 9/1993 Mitsunaga et al.
5,256,042 A * 10/1993 McCullough ..... F04C 18/023 418/55.6
5,256,044 A 10/1993 Nieter et al.
5,263,822 A 11/1993 Fujio
5,277,563 A 1/1994 Wen-Jen et al.
5,314,316 A 5/1994 Shibamoto et al.
5,328,341 A 7/1994 Forni
5,421,709 A * 6/1995 Hill ..... F04C 29/02 418/55.6
5,449,279 A 9/1995 Hill et al.
5,462,419 A 10/1995 Hill et al.
5,490,769 A 2/1996 Calhoun
5,609,478 A 3/1997 Utter et al.
5,624,243 A 4/1997 Omodaka et al.
5,632,611 A 5/1997 Sekiya et al.
5,713,731 A * 2/1998 Utter ..... F04C 18/023 418/55.6
5,791,883 A 8/1998 Ban et al.
6,359,357 B1 3/2002 Blumenstock
6,616,430 B2 9/2003 Mori et al.
6,692,205 B2 2/2004 Moroi et al.
6,712,589 B2 3/2004 Mori et al.
6,776,593 B1 8/2004 Cho
6,993,910 B2 2/2006 Iwanami et al.
7,201,567 B2 4/2007 Wiertz et al.
7,344,367 B2 3/2008 Manole
8,007,260 B2 8/2011 Yanagisawa
8,058,762 B2 11/2011 Asano
8,179,016 B2 5/2012 Asano
8,323,006 B2 12/2012 Schofield et al.
8,373,326 B2 2/2013 Enomoto et al.
8,894,388 B2 11/2014 Lee et al.
9,169,841 B2 10/2015 Bonnefoi et al.
9,534,599 B2 1/2017 Rosson et al.
9,719,510 B2 8/2017 Fujioka et al.
10,215,174 B2 2/2019 Stover et al.
10,280,922 B2 5/2019 Doepker et al.
10,400,770 B2 9/2019 Fullenkamp et al.
10,415,567 B2 9/2019 Doepker et al.
10,465,954 B2 11/2019 Doepker et al.
10,718,330 B2 7/2020 Stover et al.
10,995,754 B2 5/2021 Doepker et al.
11,041,494 B2 6/2021 Hirata et al.
11,624,366 B1 4/2023 Ignatiev et al.
2001/0012489 A1 8/2001 Harakawa et al.
2002/0150485 A1 10/2002 Mori et al.
2002/0182094 A1 12/2002 Mori et al.
2005/0031465 A1 2/2005 Dreiman et al.
2005/0201884 A1 9/2005 Dreiman
2007/0077159 A1 4/2007 Tsuchiya et al.
2008/0087033 A1 4/2008 Bae et al.
2008/0240957 A1 10/2008 Yanagisawa
2009/0104060 A1 4/2009 Sato et al.
2009/0123315 A1 5/2009 Nakamura et al.
2010/0164313 A1 7/2010 Langford et al.
2010/0225195 A1 9/2010 Asano et al.
2011/0002797 A1 1/2011 Takeuchi et al.
2011/0038737 A1 2/2011 Conry et al.
2012/0131945 A1 5/2012 Huang et al.
2012/0171060 A1 7/2012 Shin et al.
2012/0288393 A1 11/2012 Sato
2013/0036762 A1 2/2013 Shaffer et al.
2013/0181565 A1 7/2013 Petro et al.
2014/0361651 A1 12/2014 Park et al.
2016/0043602 A1 2/2016 Hosek et al.
2016/0123147 A1 5/2016 Fujioka et al.
2017/0051741 A1 2/2017 Shaffer et al.
2018/0013336 A1 1/2018 Li
2018/0080446 A1 3/2018 Choi et al.
2018/0087509 A1 3/2018 Johnson et al.
2018/0223842 A1 8/2018 Stover et al.
2018/0223843 A1* 8/2018 Doepker ..... F04C 27/001
2018/0223848 A1 8/2018 Doepker et al.
2018/0223849 A1 8/2018 Doepker et al.
2018/0224171 A1 8/2018 Doepker et al.
2018/0252216 A1 9/2018 Lee et al.
2018/0363654 A1 12/2018 Doepker et al.
2019/0162184 A1 5/2019 Yamashita et al.
2019/0178247 A1 6/2019 Yamashita et al.
2019/0186488 A1 6/2019 Stover et al.
2019/0376513 A1 12/2019 Hirata et al.
2020/0018310 A1 1/2020 Hirata et al.
2020/0025199 A1 1/2020 Wilson et al.
2020/0158109 A1 5/2020 Jo et al.
2020/0232460 A1 7/2020 Kitaguchi et al.

FOREIGN PATENT DOCUMENTS

CN 101682226 A 3/2010
CN 102480197 A 5/2012
CN 102777382 A 11/2012
CN 103807166 A 5/2014
CN 104520599 A 4/2015
CN 105612351 A 5/2016
CN 105971880 A 9/2016
CN 108397386 A 8/2018
CN 208106754 U 11/2018
CN 208106761 U 11/2018
CN 208106763 U 11/2018
CN 208138137 U 11/2018
CN 109661518 A 4/2019
DE 102018107460 A1 10/2018
EP 0534891 A1 3/1993
EP 0692074 A1 1/1996
IN 108397382 A 8/2018
JP S59110885 A 6/1984
JP S62210279 A 9/1987
JP H02140477 A 5/1990
JP H02207190 A 8/1990
JP H05195966 A 8/1993
JP H06101659 A 4/1994
JP H06213232 A 8/1994
JP H0712076 A 1/1995
JP H07229481 A 8/1995
JP H07259760 A 10/1995
JP H07332260 A 12/1995
JP H08121358 A 5/1996
JP H08144972 A 6/1996
JP 2004052657 A 2/2004
JP 2012115084 A 6/2012
JP 2012215092 A 11/2012
JP 2015001176 A 1/2015
JP 2015004296 A 1/2015
JP 2015124653 A 7/2015
JP 2018-100640 A 6/2018
JP 2018132036 A 8/2018
KR 910001253 A 1/1991
KR 200167998 Y1 2/2000
KR 20110000545 A 1/2011

(56) References Cited

FOREIGN PATENT DOCUMENTS

| | | | |
|---|---|---|---|
| KR | 20120069713 | A | 6/2012 |
| KR | 20150006278 | A | 1/2015 |
| KR | 20160091106 | A | 8/2016 |
| KR | 20180031389 | A | 3/2018 |
| TW | 223674 | B | 5/1994 |
| WO | WO-2018116696 | A1 | 6/2018 |
| WO | WO-2018134739 | A1 | 7/2018 |
| WO | WO-2020050826 | A1 * | 3/2020 |

OTHER PUBLICATIONS

English language translation equivalent for TW-223674-B is provided in the form of EP-0534891-A1.
English language translation equivalent for JP-S62210279-A is provided in the form of U.S. Pat. No. 4,846,639-A.
U.S. Appl. No. 17/519,721, filed Nov. 5, 2021, Kirill M. Ignatiev.
U.S. Appl. No. 17/519,876, filed Nov. 5, 2021, Kirill M. Ignatiev.
Non-Final Office Action regarding U.S. Appl. No. 17/097,478 dated Nov. 1, 2021.
Hasegawa, Hiroshi et al., "Dynamic Analysis of a Co-Rotating Scroll Compressor." International Compressor Engineering Conference, Paper 1313, pp. 643-648 (1998).
McMullen, Patrick T. et al., "Combination Radial-Axial Magnetic Bearing." Seventh International Symposium on Magnetic Bearings, Zürich (Aug. 23-25, 2000).
Hinckley, Mark, "New Levels of Performance with Magnetic Bearings." Design World, https://www.designworldonline.com/new-levels-of-performance-with-magnetic-bearings/ (Oct. 8, 2010).
Mahmoudi, A. et al., "Axial-flux permanent-magnet machine modeling, design, simulation and analysis." Scientific Research and Essays, vol. 6, No. 12, pp. 2525-2549 (Jun. 18, 2011).
Faculty of Engineering—Electric Energy Group, "Design of Electric Machines: Axial Flux Machines." Electric Energy Magazine, No. 4, Mondragon Unibertsitatea, pp. 1-21 (Jan.-Jun. 2013).
Frank, Evan et al., "Ring Motors—Design Flexibility for Innovative Configurations." Motion Control and Automation Technology, NASA Tech Briefs, pp. 14-15 (Sep. 2014).
Office Action regarding U.S. Appl. No. 15/205,907, dated May 29, 2018.
International Search Report regarding International Application No. PCT/US2018/017069, dated Jun. 12, 2018.
Written Opinion of the International Searching Authority regarding International Application No. PCT/US2018/017069, dated Jun. 12, 2018.
Search Report regarding European Patent Application No. 18155363.7, dated Jul. 2, 2018.
Search Report regarding European Patent Application No. 18155362.9, dated Jul. 2, 2018.
Office Action regarding U.S. Appl. No. 15/425,374, dated Jul. 27, 2018.
Restriction Requirement regarding U.S. Appl. No. 15/425,428, dated Aug. 8, 2018.
Search Report regarding European Patent Application No. 18155358.7, dated Oct. 11, 2018.
Office Action regarding U.S. Appl. No. 15/425,428, dated Nov. 1, 2018.
Notice of Allowance regarding U.S. Appl. No. 15/425,374, dated Nov. 7, 2018.
Notice of Allowance regarding U.S. Appl. No. 15/425,374, dated Nov. 30, 2018.
Office Action regarding U.S. Appl. No. 16/114,912, dated Dec. 3, 2018.
Restriction Requirement regarding U.S. Appl. No. 15/425,319, dated Jan. 10, 2019.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.
Office Action regarding U.S. Appl. No. 15/425,319, dated Apr. 1, 2019.
Office Action regarding Korean Patent Application No. 10-2018-0013620, dated May 28, 2019. Translation provided by KS KORYO International IP Law Firm.
Restriction Requirement regarding U.S. Appl. No. 15/425,266, dated May 28, 2019.
Notice of Allowance regarding U.S. Appl. No. 16/114,912, dated Jun. 10, 2019.
Office Action regarding Korean Patent Application No. 10-2018-0013622, dated Jun. 26, 2019. Translation provided by KS KORYO International IP Law Firm.
Office Action regarding U.S. Appl. No. 16/284,653, dated Jul. 29, 2019.
Notice of Allowance regarding U.S. Appl. No. 15/425,319, dated Aug. 7, 2019.
Office Action regarding U.S. Appl. No. 15/205,907, dated Aug. 9, 2019.
Office Action regarding Chinese Patent Application No. 201810116198.8, dated Aug. 26, 2019. Translation provided by Unitalen Attorneys at Law.
Office Action regarding Chinese Patent Application No. 201810118025.X, dated Aug. 28, 2019. Translation provided by Unitalen Attorneys at Law.
Office Action regarding Indian Patent Application No. 201824003471, dated Sep. 11, 2019.
Office Action regarding Mexican Patent Application No. MX/a/2017/008998, dated Oct. 1, 2019. Translation provided by Panamericana de Patentes y Marcas, S.C.
Office Action regarding U.S. Appl. No. 15/425,266, dated Oct. 8, 2019.
Office Action regarding Chinese Patent Application No. 201810119178.6, dated Oct. 18, 2019. Translation provided by Unitalen Attorneys at Law.
Office Action regarding Chinese Patent Application No. 201810118025.X, dated Feb. 25, 2020. Translation provided by Unitalen Attorneys at Law.
Notice of Allowance regarding U.S. Appl. No. 16/284,653, dated Mar. 12, 2020.
Office Action regarding U.S. Appl. No. 15/425,266, dated Apr. 3, 2020.
Office Action regarding U.S. Appl. No. 15/877,870, dated Apr. 13, 2020.
Office Action regarding Chinese Patent Application No. 201880016172.4, dated Jul. 1, 2020. Translation provided by Unitalen Attorneys at Law.
Office Action regarding Chinese Patent Application No. 201710551365.7, dated Jul. 3, 2020. Summary translation provided by Zhongzi Law Office.

(56) References Cited

OTHER PUBLICATIONS

Office Action regarding U.S. Appl. No. 15/425,266, dated Jul. 6, 2020.
Office Action regarding U.S. Appl. No. 15/425,266, dated Aug. 28, 2020.
Office Action regarding European Patent Application No. 18155362.9, dated Oct. 2, 2020.
Office Action regarding European Patent Application No. 18155358.7, dated Oct. 6, 2020.
Office Action regarding European Patent Application No. 18155363.7, dated Oct. 7, 2020.
Ex Parte Quayle Action regarding U.S. Appl. No. 15/877,870, dated Oct. 19, 2020.
Office Action regarding Korean Patent Application No. 10-2019-7023591, dated Oct. 19, 2020. Translation provided by Y.S. Chang & Associates.
Notice of Allowance regarding U.S. Appl. No. 15/877,870, dated Jan. 28, 2021.
Office Action regarding U.S. Appl. No. 15/425,266, dated Feb. 10, 2021.
Office Action regarding Chinese Patent Application No. 201880016172.4, dated Feb. 26, 2021. Translation provided by Unitalen Attorneys at Law.
International Search Report regarding International Application No. PCT/US2020/060527, dated Mar. 5, 2021.
Written Opinion of the International Searching Authority regarding International Application No. PCT/US2020/060527, dated Mar. 5, 2021.
Notice of Allowance regarding U.S. Appl. No. 15/425,266 dated May 19, 2021.
Supplemental Notice of Allowability regarding U.S. Appl. No. 15/425,266 dated May 27, 2021.
Search Report regarding European Patent Application No. 21186670.2, dated Oct. 26, 2021.
Notice of Allowance regarding U.S. Appl. No. 17/097,478 dated Feb. 16, 2022.
Non-Final Office Action regarding U.S. Appl. No. 17/519,721, dated Aug. 2, 2022.
Notice of Allowance regarding U.S. Appl. No. 17/519,876 dated Dec. 8, 2022.
International Search Report and Written Opinion regarding Application No. PCT/US2022/046553 dated Feb. 17, 2023.
International Search Report and Written Opinion regarding Application No. PCT/US2022/048544 dated Mar. 15, 2023.
Notice of Allowance regarding U.S. Appl. No. 17/519,721 dated Apr. 6, 2023.
Office Action regarding Chinese Patent Application No. 2020800795746 dated May 9, 2023.
Non-Final Office Action issued on Sep. 11, 2023 for U.S. Appl. No. 18/117,787.

* cited by examiner 10
34
H
G
33
26
25
93
94
92
40
106
F
107
104
102
14
112
108
109
111
110
22
38
113
88
98
96
86
E
12
A2
78
42
114
85
82
18
74
90
76
41
30
72
84
D
B
83
68
16
80
50
70
67
58
66
52
C
C
54
46
56
62
24
65
64
59
32
A1
A

CO-ROTATING COMPRESSOR

FIELD

The present disclosure relates to a compressor in a refrigeration system and, more particularly, to a co-rotating compressor.

BACKGROUND

This section provides background information related to the present disclosure which is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid between the condenser and the evaporator. Efficient and reliable operation of the compressor is desirable to ensure that the cooling, refrigeration, or heat pump system in which the compressor is incorporated is capable of effectively and efficiently providing a cooling and/or heating effect on demand.

The compressor takes working fluid from a suction end, compresses the fluid, and discharges the working fluid through a discharge outlet. The compression process generates heat within the compressor. Additionally, the motor generates its own heat. In some cases, the heat may be dissipated naturally. However, in some cases, additional cooling may be necessary to dissipate heat and reduce motor temperatures. Reduction in motor temperatures results in lower potential for motor overheating and failure.

SUMMARY

This section provides a general summary of the disclosure and is not a comprehensive disclosure of its full scope or all of its features.

An example compressor according to the present disclosure includes a compression mechanism, a driveshaft, and a motor. The compression mechanism may be configured to compress a fluid to a discharge pressure. The motor may be configured to rotate the driveshaft. The driveshaft may be engaged with the compression mechanism and may be fixed to rotate with at least a portion of the compression mechanism. The driveshaft may include a longitudinal aperture configured to receive the fluid at a suction pressure, and includes a flange that receives at least a portion of the compression mechanism. The flange and the compression mechanism may define a fluid passage therebetween. The fluid at suction pressure may be received within the fluid passage from the longitudinal aperture in the driveshaft.

The example compressor may further include a shell defining an internal space. The compression mechanism, the driveshaft, and the motor may be disposed within the shell. The fluid at suction pressure or the fluid at discharge pressure may circulate through the internal space and the motor is configured to transfer heat away from the motor.

The shell may include a body, an endcap, and a partition. The body may define the internal space. The endcap and the partition may define a discharge-pressure chamber. The internal space may be a suction-pressure chamber.

The shell may include a body, an endcap, and a partition. The body may define the internal space. The endcap and the partition may define a suction-pressure chamber. The internal space may be a discharge-pressure chamber.

The example compressor may further include a shaft engaged with the compression mechanism and fixed in a stationary position. The shaft may include a longitudinal discharge aperture. The longitudinal discharge aperture may be in fluid communication with a discharge port of the compression mechanism.

The example compressor may further include a bearing housing fixed to rotate with at least a portion of the compression mechanism. The shaft may be supported within the bearing housing by a first bearing. The shaft may be supported within the compression mechanism by a second bearing.

The example compressor may further include a first seal engaged with the shaft and the bearing housing. The first seal may be configured to prevent flow of fluid from the compression mechanism or an interface between the discharge port and the longitudinal discharge aperture.

The motor may be fixed radially outside of the bearing housing.

The example compressor may further include a shell configured to house the compression mechanism, the driveshaft, and the motor. The shell may include a body, an endcap, and a partition. The shaft may be fixed to or integral with the endcap.

The example compressor may further include a shell configured to house the compression mechanism, the driveshaft, and the motor. The shell may include a body, an endcap, and a partition. The shaft may be fixed to or integral with the partition.

The compression mechanism may include an orbiting scroll and a non-orbiting scroll. The orbiting scroll may be fixed for rotation with the flange and may include an axial passage in fluid communication with the fluid passage between the compression mechanism and the flange.

The driveshaft may be supported by a bearing on a proximal end and engaged with the compression mechanism on a distal end.

The example compressor may include a seal engaged with the driveshaft and the bearing. The seal may be configured to prevent flow of fluid from a suction-pressure inlet or an interface between the suction pressure inlet and the driveshaft.

The example compressor may include an impeller disposed between the compression mechanism and the flange. The impeller may define the fluid passage.

The impeller may be formed with an end plate of the compression mechanism as a single, monolithic part.

An example compressor according to the present disclosure includes a shell, a compression mechanism, a driveshaft, and a motor. The shell may have a body, an end cap, and a partition. The compression mechanism may be housed within the shell and may be configured to compress a fluid to a discharge pressure. The driveshaft may be housed within the shell, engaged with the compression mechanism, and fixed to rotate with at least a portion of the compression mechanism. The motor may be housed within the shell and configured to rotate the driveshaft. The driveshaft may include a longitudinal aperture configured to receive the fluid at a suction pressure. The body, the end cap, and the partition defining one of a discharge-pressure chamber and a suction-pressure chamber. The compression mechanism and the motor may be housed in the one of the discharge-pressure chamber and the suction-pressure chamber.

The body, the end cap, and the partition may define the discharge-pressure chamber.

The body, the end cap, and the partition may define the suction-pressure chamber.

An example compressor according to the present disclosure includes a shell, a compression mechanism, a driveshaft, and a motor. The shell may include a body, an end cap, and a partition. The compression mechanism may be housed within the shell and configured to compress a fluid to a discharge pressure. The driveshaft may be housed within the shell, engaged with the compression mechanism, and fixed to rotate with at least a portion of the compression mechanism. The motor may be housed within the shell and configured to rotate the driveshaft. The fluid passage may extend from a fluid inlet to a fluid outlet, and the fluid passage may extend through a longitudinal aperture in the driveshaft and the compression mechanism. The fluid passage may extend into the shell and through the motor to transfer heat away from the motor.

The body, the end cap, and the partition may define one of a discharge-pressure chamber and a suction-pressure chamber. The motor may be housed in the one of the discharge-pressure chamber and the suction-pressure chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
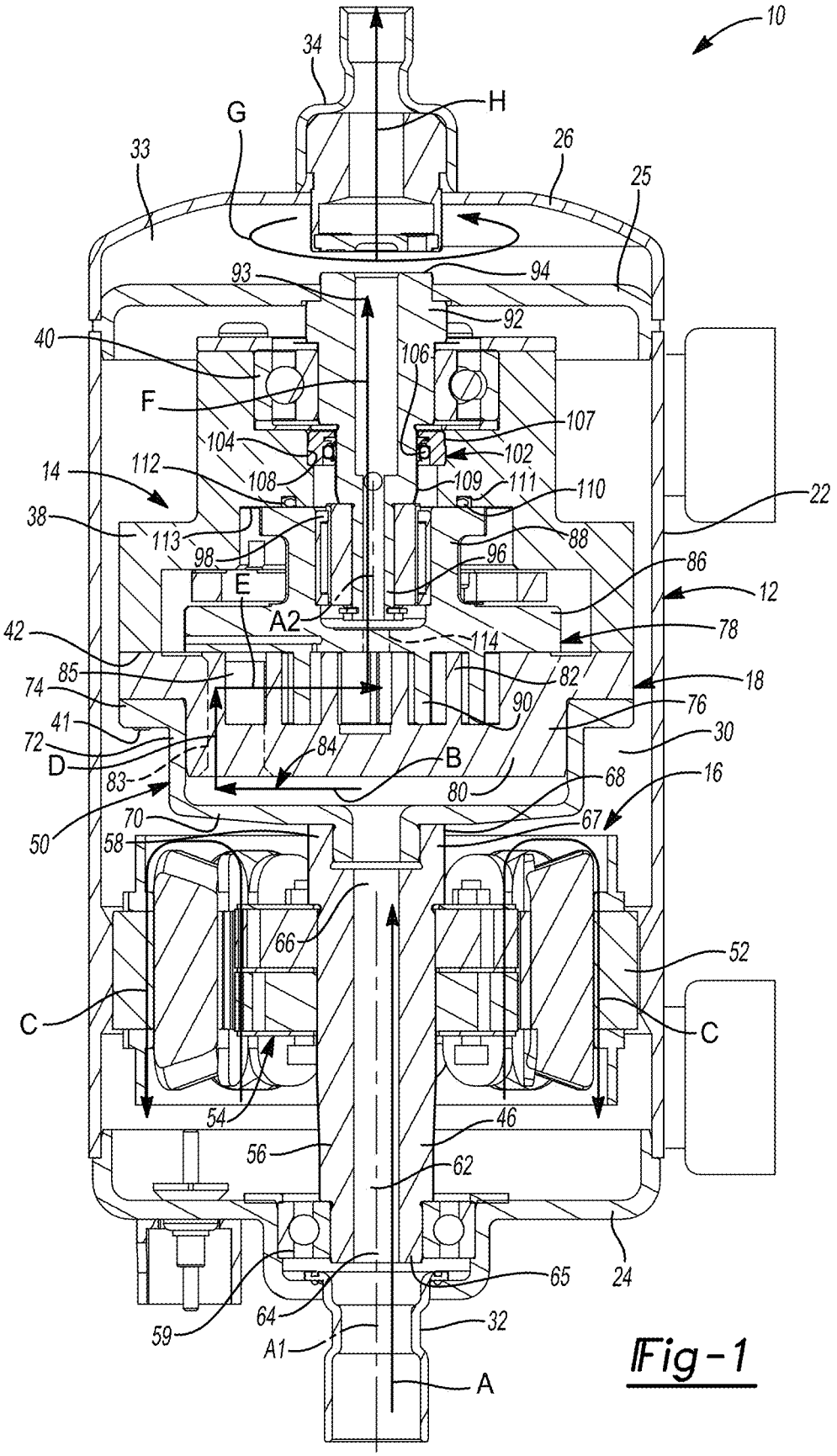
FIG. 1 is a cross-sectional view of an example compressor according to the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure relates to refrigerant flow through a sumpless co-rotating scroll compressor. Co-rotating compressor technology allows for a reduction in size due to the absence of counterweights and reduction of flank forces.

With reference to FIG. 1, a compressor 10 is provided that may include a hermetic shell assembly 12, a bearing housing assembly 14, a motor assembly 16, and a compression mechanism 18.

The shell assembly 12 may generally form a compressor housing and may include a cylindrical shell 22, a first end cap 24 at one end of the shell 22, a partition 25 and a second end cap 26 at another end of the shell 22. The shell 22 and the first end cap 24 may cooperate to define a suction-pressure chamber 30. A suction gas inlet fitting 32 may be attached to the shell assembly 12 at an opening in the first end cap 24. Suction-pressure working fluid (i.e., low-pressure working fluid) may be drawn into the compression mechanism 18 via the suction gas inlet fitting 32 for compression therein.

Figure 2:
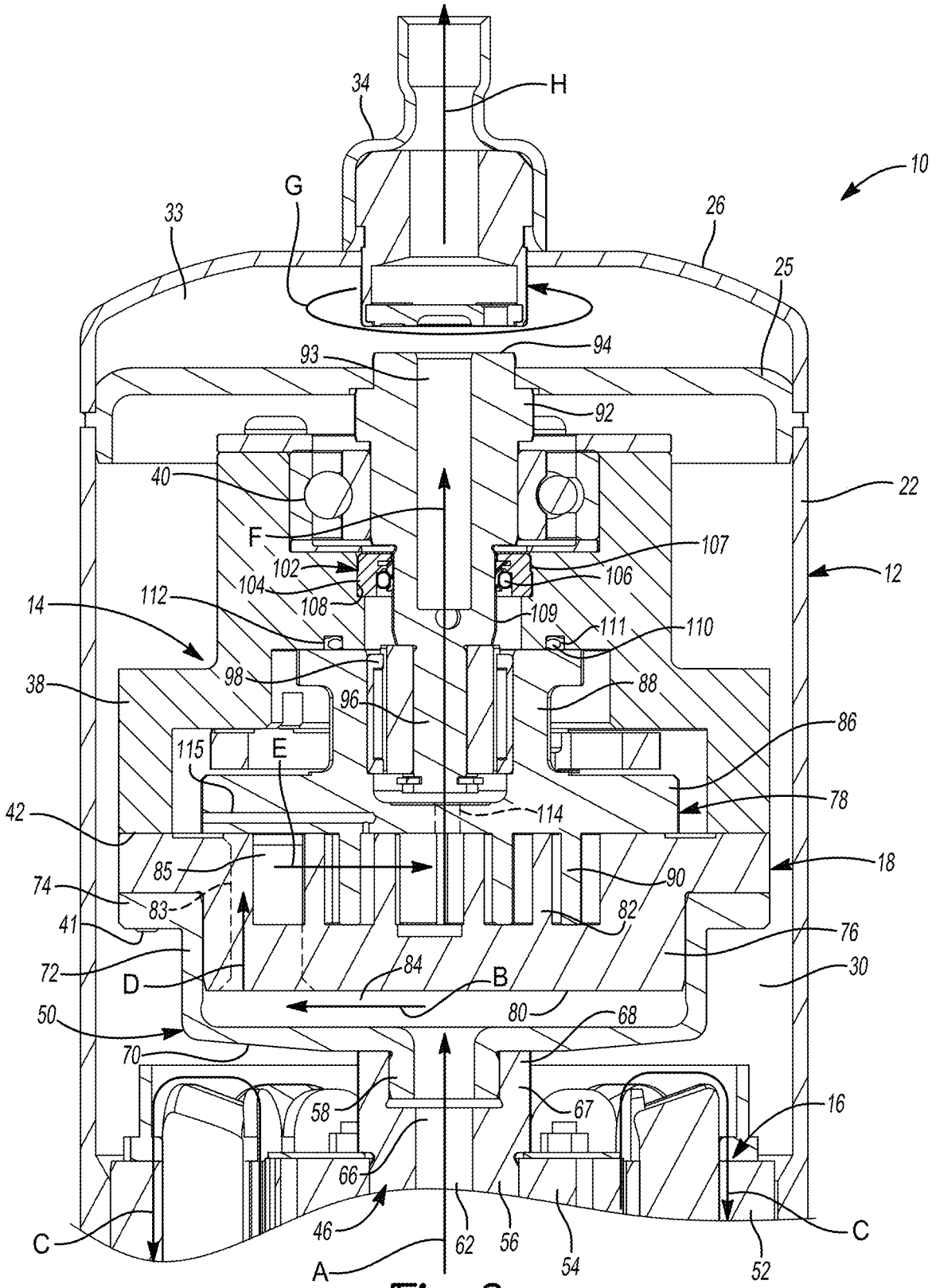
FIG. 2 is another cross-sectional view of the compressor of FIG. 1.

As shown in FIGS. 1 and 2, the partition 25 and the second end cap 26 may cooperate to define a discharge-pressure chamber 33. The partition 25 may separate the discharge-pressure chamber 33 from the suction-pressure chamber 30. A discharge gas outlet fitting 34 may be attached to the shell assembly 12 at another opening in the second end cap 26 and may communicate with the discharge-pressure chamber 33. Discharge-pressure working fluid (i.e., working fluid at a higher pressure than suction pressure) may be discharged by the compression mechanism 18 and may flow into the discharge-pressure chamber 33. The discharge-pressure working fluid in the discharge-pressure chamber 33 may exit the compressor 10 through the discharge-gas-outlet fitting 34. In some configurations, a discharge valve (e.g., a check valve) may be disposed within or adjacent the discharge-gas-outlet fitting 34 and may allow fluid to exit the discharge-pressure chamber 33 through the discharge-gas-outlet fitting 34 and prevent fluid from entering the discharge-pressure chamber 33 through the discharge-gas-outlet fitting 34.

The bearing housing assembly 14 may be disposed within the suction-pressure chamber 30 and may include a main bearing housing 38 and a bearing 40. The main bearing housing 38 may house the bearing 40 therein. The bearing 40 may be a rolling element bearing or any other suitable type of bearing. The main bearing housing 38 may include a plurality of cylindrically-shaped fasteners, such as pins or bolts, 41 (FIG. 3) extending in an axial direction from an axial end surface 42 of the main bearing housing 38. The fasteners 41 may be spaced apart from each other and may be disposed circumferentially around the axial end surface 42 of the main bearing housing 38. Each fastener 41 may have a proximate end 43 and a distal end 44. The proximate end 43 may extend from the axial end surface 42 of the main bearing housing 38. The distal end 44 may be coupled to a hub 50 engaged with the driveshaft 46 such that the bearing housing 38 is coupled to the driveshaft 46. In some configurations, the fasteners 41 may be separate components that are attached to the axial end surface 42 of the main bearing housing 38 through threads or a press-fit instead of being integrally formed with the axial end surface 42 of the main bearing housing 38.

The motor assembly 16 may be disposed within the suction-pressure chamber 30 and may include a motor stator 52 and a rotor 54. The motor stator 52 may be attached to the shell 22 (e.g., via press fit, staking, and/or welding). The rotor 54 may be attached to the driveshaft 46 (e.g., via press fit, staking, and/or welding). The driveshaft 46 may be driven by the rotor 54 and may be supported by bearing 59 for rotation relative to the shell assembly 12. The bearing 59 may be fixed to the first end cap 24 of the shell assembly 12. In some configurations, the motor assembly 16 is a variable-speed motor. In other configurations, the motor assembly 16 could be a multi-speed motor or a fixed-speed motor.

The driveshaft 46 may include a driveshaft section 56 and the hub 50. The driveshaft section 56 may include a suction passage 62. The suction passage 62 provides fluid communication between the suction gas inlet fitting 32 and the compression mechanism 18. An inlet 64 of the suction passage 62 may be disposed at or near a first end 65 of the driveshaft section 56 adjacent the suction gas inlet fitting 32. An outlet 66 of the suction passage 62 may be disposed at or near a second end 67 of the driveshaft section 56 adjacent to the compression mechanism 18. The second end 67 of the driveshaft section 56 may include a flange 68 for engaging the driveshaft section 56 with the hub 50. The suction passage 62 may be coated in a thermal insulation coating to prevent preheat of the working fluid. For example, the thermal insulation coating may include, but is not limited to, ceramics, silicone or thermal insulating sprays.

Figure 3:
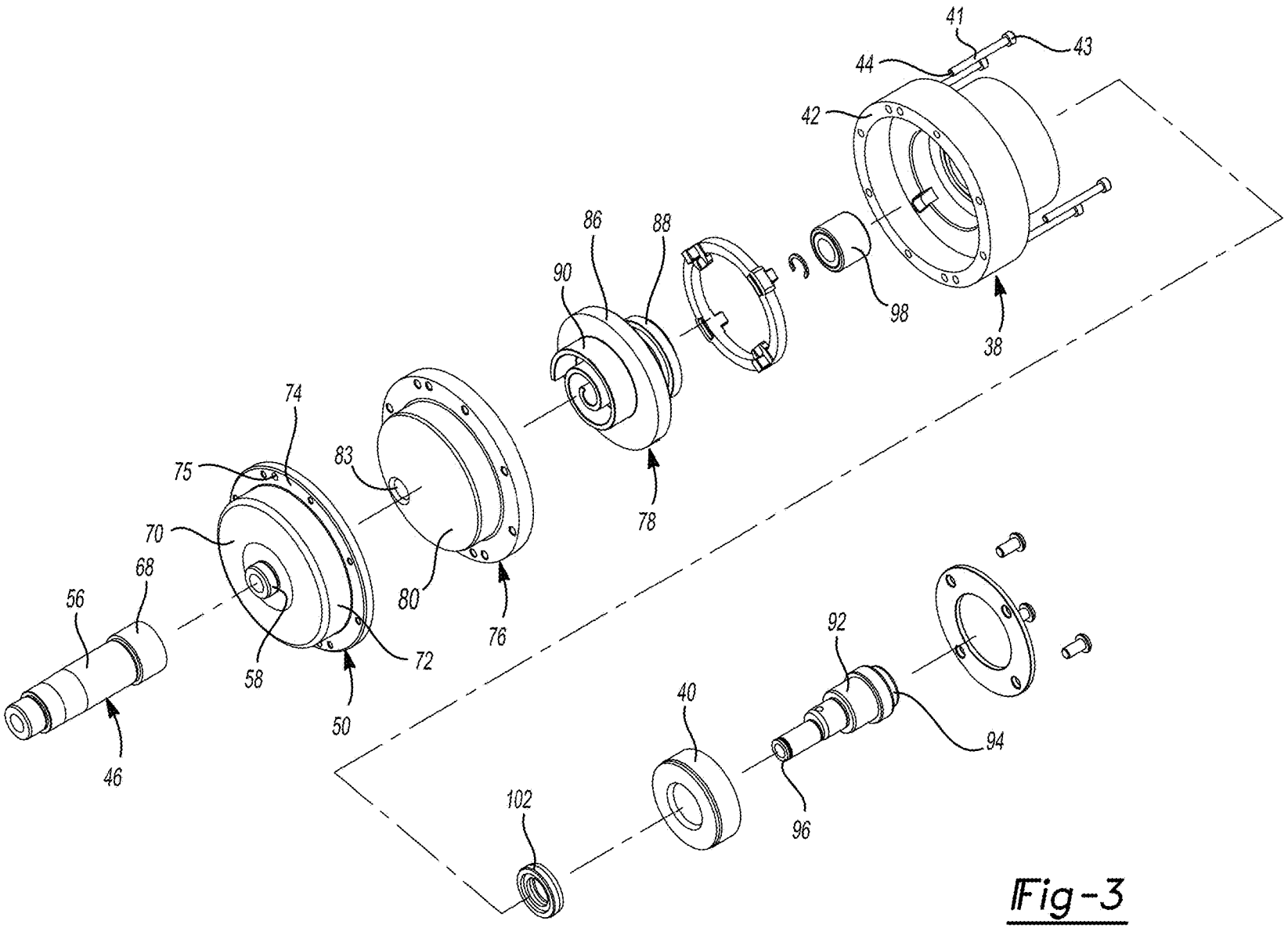
FIG. 3 is an exploded view of the compressor of FIG. 1.

A first axial portion 58 of the hub 50 may engage with the second end 67 of the driveshaft section 56. More particularly, the flange 68 on the second end 67 of the driveshaft section 56 may be fixed to the first axial portion 58 of the hub 50. The hub 50 may further include a radial portion 70, a second axial portion 72, and a flange 74. The radial portion 70 extends in a radial direction from the first axial portion 58 of the hub 50 (in a direction perpendicular to a rotational axis A1 of driveshaft 46) and the second axial portion 72 extends in an axial direction from a periphery of the radial portion 70 (in a direction parallel to a rotational axis A1 of driveshaft 46). The flange 74 extends in a radial direction from an end of the second axial portion 72 and includes a plurality of fastener housings 75. As shown in FIG. 3, the fastener housings 75 are spaced apart from each other and are circumferentially disposed around the flange 74. Each fastener 41 extending from the main bearing housing 38 is received in a respective fastener housing 75, thereby coupling the main bearing housing 38 and the hub 50 to each other. In this manner, rotation of the driveshaft 46 causes corresponding rotation of the main bearing housing 38 about the rotational axis A1 of the driveshaft 46.

The compression mechanism 18 may be disposed within the suction-pressure chamber 30. The compression mechanism 18 may include a first compression member and a second compression member that cooperate to define fluid pockets (i.e., compression pockets) therebetween. For example, the compression mechanism 18 may be a co-rotating scroll compression mechanism in which the first compression member is a first scroll member (i.e., a driver scroll member) 76 and the second compression member is a second scroll member (i.e., a driven scroll member) 78.

The first scroll member 76 may include a first end plate 80 and a first spiral wrap 82 extending from the first end plate 80. The first end plate 80 is disposed within and fixed to the flange 50 of the driveshaft 46 such that the flange 50 surrounds the first spiral wrap 82. In some configurations, the first scroll member 76 and the driveshaft 46 may be a single component as opposed two separate components fixed to each other. The first end plate 80 may include an axially extending passage 83. A radially extending passage 84 is formed between the first end plate 80 and the flange 50 and extends from a central area of the first end plate 80 to the axially extending passage 83. The axially extending passage 83 extends from an end of the radially extending passage 84 to a suction inlet 85 of the first scroll member 76. In this way, suction gas flowing through the suction passage 62 may flow through the passages 83, 84 and into an outermost pocket of the fluid pockets via the suction inlet 85. A portion of the suction gas flowing through the passages 83, 84 may exit into the suction pressure-chamber 30.

The second scroll member 78 defines a second rotational axis A2 that is parallel to the rotational axis A1 and offset from the rotational axis A1. The second scroll member 78 may include a second end plate 86, a cylindrical hub 88 extending from one side of the second end plate 86, and a second spiral wrap 90 extending from the opposite side of the second end plate 86. A stationary crank 92 with discharge passage 93 is coupled to the partition 25 and includes a first end 94 extending at least partially into the discharge-pressure chamber 33 and a second end 96 extending through the bearing 40 and into the hub 88 (the bearing 40 is disposed within the suction-pressure chamber 30). The passage 93 extends axially through the stationary crank 92 (i.e., through the first and second ends 94, 96) and provides fluid communication between the compression mechanism 18 and the discharge-pressure chamber 33. The discharge passage 93 may be coated with a thermal insulation coating to prevent heat transfer from the compressed working fluid to the compressor parts. For example, the thermal insulation coating may include, but is not limited to, ceramics, silicone or thermal insulating sprays. The hub 88 of the second scroll member 78 is rotatably supported by a bearing 98 (e.g., a needle bearing) that is positioned between the hub 88 and the stationary crank 92. Oldham coupling 95 may provide synchronized rotational motion of the driven scroll 78 from the housing 38.

A sealing assembly 102 is disposed within the main bearing housing 38 and includes a housing 104 and a sealing member 106. The housing 104 is press-fitted within the main bearing housing 38 such that an outer diametrical surface 107 of the housing 104 is sealingly engaged with an inner diametrical surface 108 of the main bearing housing 38. The sealing member 106 is disposed within the housing 104 and is sealingly engaged with an outer diametrical surface 109 of the stationary crank 92. In this way, fluid discharged from the fluid pockets of the compression mechanism 18 is prevented from flowing to the bearing 40 and to the suction chamber 30.

The first and second spiral wraps 82, 90 are intermeshed with each other and cooperate to form a plurality of fluid pockets (i.e., compression pockets) therebetween. Synchronized rotation of the first scroll member 76 about the rotational axis A1 and rotation of the second scroll member 78 about the second rotational axis A2 causes the fluid pockets to decrease in size as they move from a radially outer position to a radially inner position, thereby compressing the working fluid therein from the suction pressure to the discharge pressure.

The second end plate 86 may be disposed axially between the first end plate 80 and the main bearing housing 38. Annular seals 110 may be disposed within a groove 111 formed in an axial surface 113 of the main bearing housing 38 and may sealingly and slidably engage the end of hub 88 to form an annular biasing chamber 112. The annular seals 110 keeps the biasing chamber 112 sealed off from the suction-pressure chamber 30 and the discharge gas while still allowing relative movement between the main bearing housing 38 and the second scroll member 78. The second end plate 86 may include a biasing passage 115 that provides fluid communication between an intermediate-pressure compression pocket and the biasing chamber 112.

The second end plate 86 may include a discharge passage 114. The discharge passage 114 extends through the second end plate 86 and provides fluid communication between a radially innermost one of the fluid pockets and the discharge-gas-outlet fitting 34 (via the passage 93 in the stationary crank 92). A discharge valve (e.g., a reed valve or other check valve) may be disposed within or adjacent the discharge passage 114 or at the end 94 of the stationary crank 92. The discharge valve allows working fluid to be discharged from the compression mechanism 18 through the discharge passage 114 and into the stationary crank 92 and prevents working fluid in the stationary crank 92 from flowing back into to the compression mechanism 18. The discharge gas flowing out of the discharge passage 114 may flow through the passage 93 of the stationary crank 92, into the discharge-pressure chamber 33 and out of the compressor 10 through the discharge-gas-outlet fitting 34.

Following the arrows in FIGS. 1 and 2, during use, a working fluid enters the inlet 65 of the compressor 10 through the suction inlet fitting 32 on the first end 67 of the compressor 10 (Arrow A). The working fluid may include both a refrigerant and an oil (for example, an oil mist). Since the compressor 10 is a sumpless compressor, the oil for heat transfer and lubrication of moving parts travels with the working fluid through the compressor 10. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, is pulled into the suction passage 62 within the driveshaft 56. The working fluid moves through the driveshaft 56 towards the compression mechanism 18 (Arrow A). The working fluid travels through the output 66 of the suction passage 62 and into the radially extending passage 84 defined by the space between the hub 50 and the first end plate 80 (Arrow B). A portion of the suction gas flowing through the passages 83, 84 may exit into the suction pressure-chamber 30.

The portion of the working fluid pulled into the suction pressure chamber 30 is circulated through the motor assembly 16 to cool and lubricate the motor assembly 16 (Arrows C). For example, the working fluid is circulated through the stator 52 and rotor 54 to absorb heat generated by operation of the rotor 54 and cool the motor assembly 16.

The main portion of the working fluid is received in the axially extending passage 83 (Arrow D) from the radially extending passage 84 (Arrow B). The axially extending passage 83 provides an entrance into the suction inlet 85 in the compression mechanism 18. The working fluid is compressed within the pockets defined by the first spiral wrap 82 of the first, driving scroll 76 and the second spiral wrap 90 of the second, driven scroll 78 (Arrow E).

The compressed working fluid is discharged through the discharge passage 114 in the second end plate 86 of the second, driven scroll 78 (Arrow F). The compressed working fluid is at a high-pressure (i.e., compression pressure) and flows through the discharge passage 93 in the stationary crank 92. The sealing assembly 102 isolates the compressed, high-pressure working fluid from the low-pressure suction pressure chamber 30. The compressed working fluid enters the discharge pressure chamber 33 (Arrow G) and exits the compressor 10 through the discharge outlet fitting 34 (Arrow H).

Figure 4:
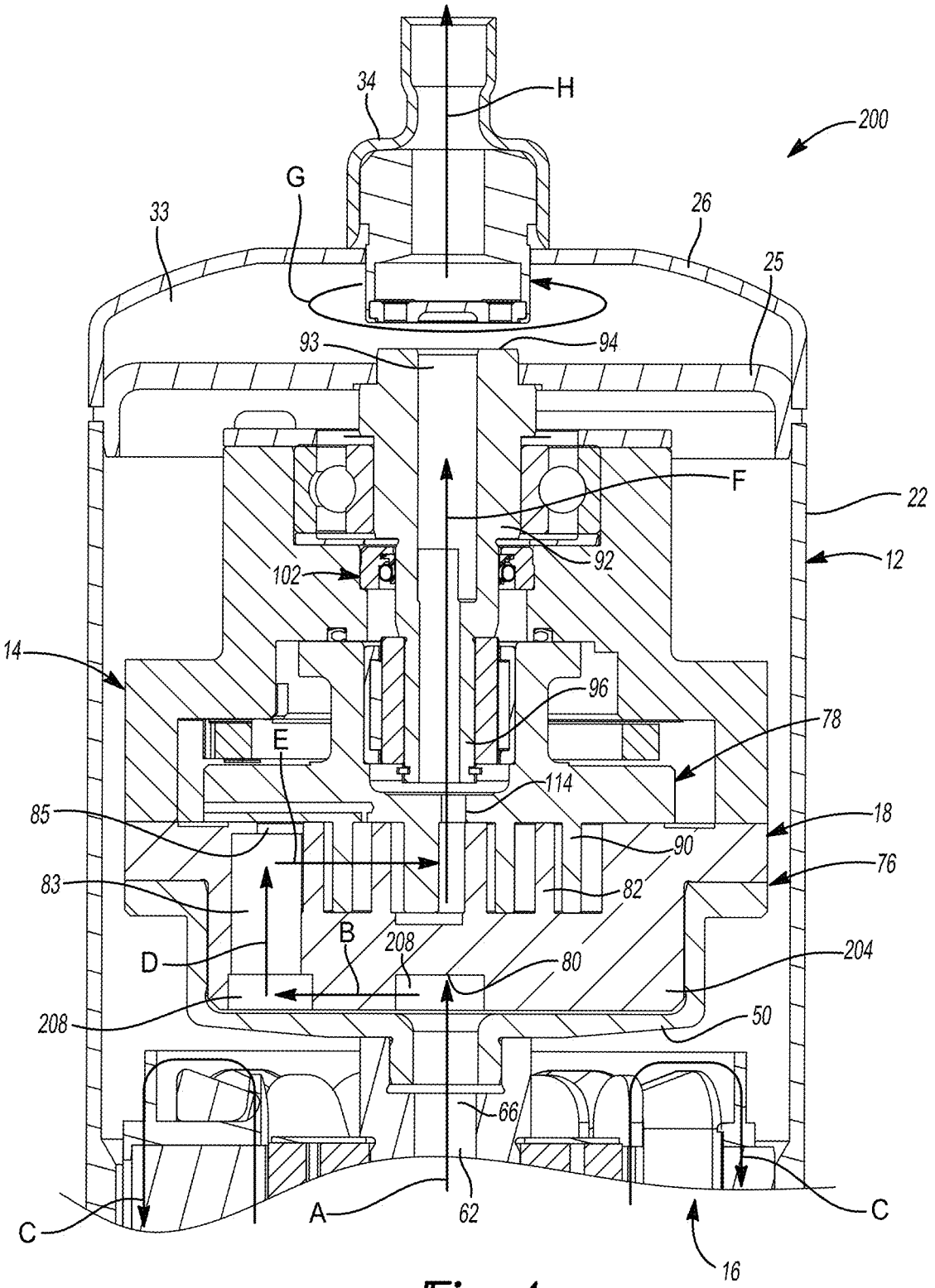
FIG. 4 is a cross-sectional view of another example compressor according to the present disclosure.

Now referring to FIG. 4, an example compressor 200 is illustrated. Compressor 200 may be the same as compressor 10, except that compressor 200 may include an impeller 204 disposed between the hub 50 and the first end plate 80 of the first scroll 76, which defines the suction plenum. Like parts between compressors 10 and 200 are shown using the same reference numbers.

Figure 5:
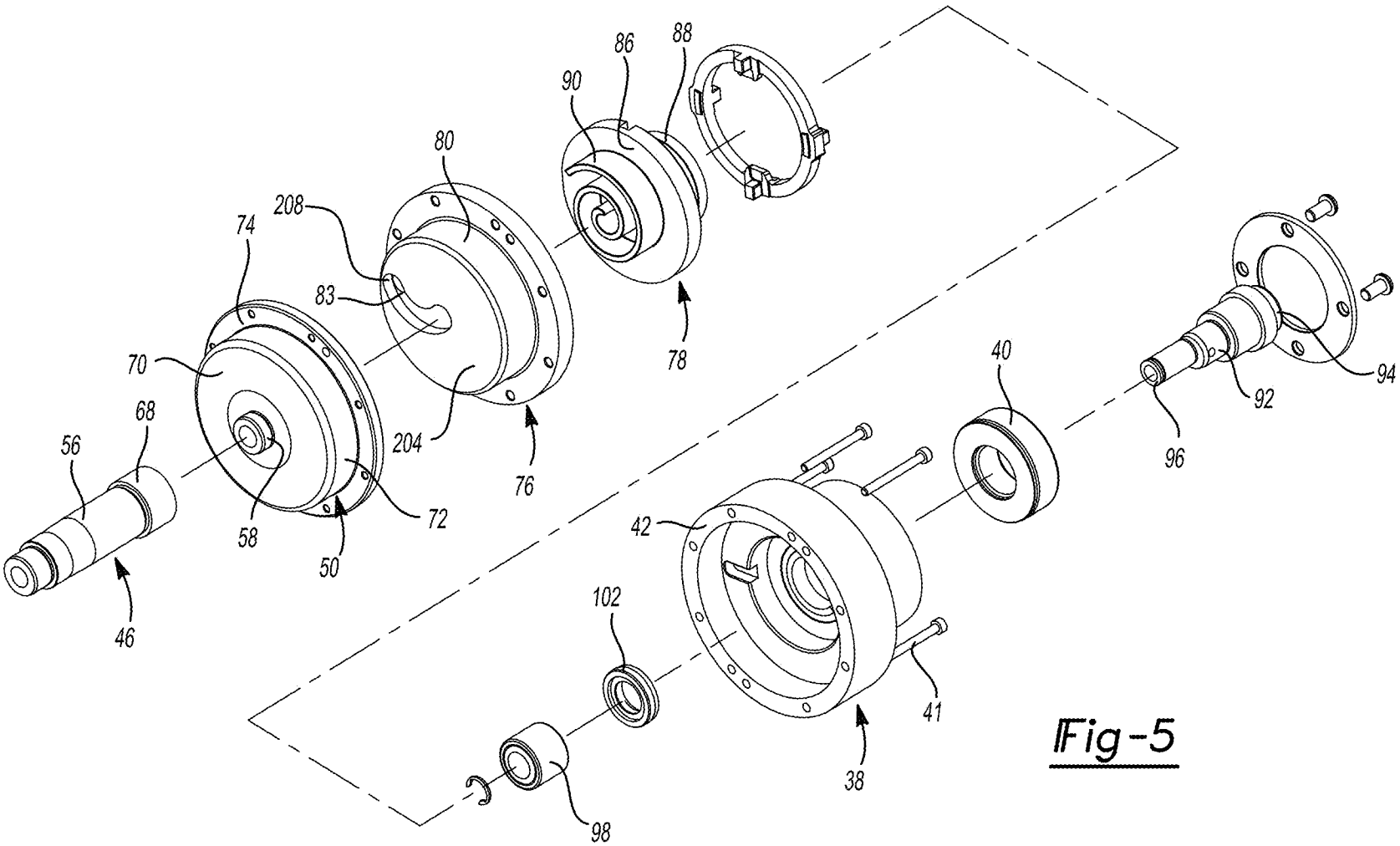
FIG. 5 is an exploded view of the compressor of FIG. 4.

As illustrated in FIGS. 4 and 5, the impeller 204 defines a passage 208 extending from the outlet 66 of the suction passage 62 to the axially extending passage 83 to streamline the gas flow from the suction passage 62 to the scroll suction port 85. The streamlined flow may reduce pressure drops between the suction passage 62 and the compression mechanism 18. Additionally, the streamlined flow may, in certain conditions, provide a supercharging effect.

Additionally, the impeller 204 provides pre-compression of the working fluid. The working fluid is dynamically compressed prior to the compression mechanism 18 utilizing a centrifugal effect.

The surface forming impeller cavity shape 204 may be formed of a thermally insulated material. For example, the thermally insulated material may include, but is not limited to, ceramics, silicone thermal insulating sprays, plastics, ceramics, or graphite. The thermally insulating impeller 204 may reduce the heat transfer into the refrigerant flowing through the passage 208 toward the suction inlet 85. Reduction in the heat transfer may improve the volumetric efficiency of the refrigerant.

The impeller 204 may be formed integrally with the first end plate 80 of the first scroll member 76 to create a single, monolithic piece. Accordingly, the position of the impeller 204 relative to the first scroll member 76 may be fixed. Further, forming the impeller 204 with the first end plate 80 creates easier and more reliable assembly of the compressor 200.

Alternatively, the impeller 204 may fit within a recessed portion in the first end plate 80 of the first scroll member 76. The recessed portion may locate and fix the position of the impeller 204 relative to the hub 50 and the first scroll member 76.

Alternatively, the impeller 204 may be formed integrally with the hub 50 or with the driveshaft 56.

Following the arrows in FIG. 4, during use, a working fluid enters the inlet, or suction passage, 62 of the compressor 200 (Arrow A). The working fluid may include both a refrigerant and an oil (for example, an oil mist). Since the compressor 10 is a sumpless compressor, the oil for heat transfer and lubrication of moving parts travels with the working fluid through the compressor 10. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, is pulled into the suction passage 62 within the driveshaft 56. The working fluid moves through the driveshaft 56 towards the compression mechanism 18 (Arrow A). The working fluid travels through the outlet 66 of the suction passage 62 and into the passage 208 defined by the impeller 204 (Arrow B). A portion of the suction gas flowing through the passage 208 may exit into the suction pressure-chamber 30.

The portion of the working fluid pulled into the suction pressure chamber 30 is circulated through the motor assembly 16 to cool the motor assembly 16 (Arrows C). For example, the working fluid is circulated through the stator 52 and rotor 54 to absorb heat generated by operation of the rotor 54 and cool the motor assembly 16.

The main portion of the working fluid is received in the axially extending passage 83 from the passage 208 (Arrow D). The axially extending passage 83 provides an entrance into the suction inlet 85 in the compression mechanism 18. The working fluid is compressed within the pockets defined by the first spiral wrap 82 of the first, driving scroll 76 and the second spiral wrap 90 of the second, driven scroll 78 (Arrow E).

The compressed working fluid is discharged through the discharge passage 114 in the second end plate 86 of the second, driven scroll 78 (Arrow F). The compressed working fluid is at a high-pressure (i.e., compression pressure) and flows through the discharge passage 93 in the stationary crank 92. The sealing assembly 102 isolates the compressed, high-pressure working fluid from the low-pressure suction pressure chamber 30. The compressed working fluid enters the discharge pressure chamber 33 (Arrow G) and exits the compressor 10 through the discharge outlet fitting 34 (Arrow H).

Figure 6:
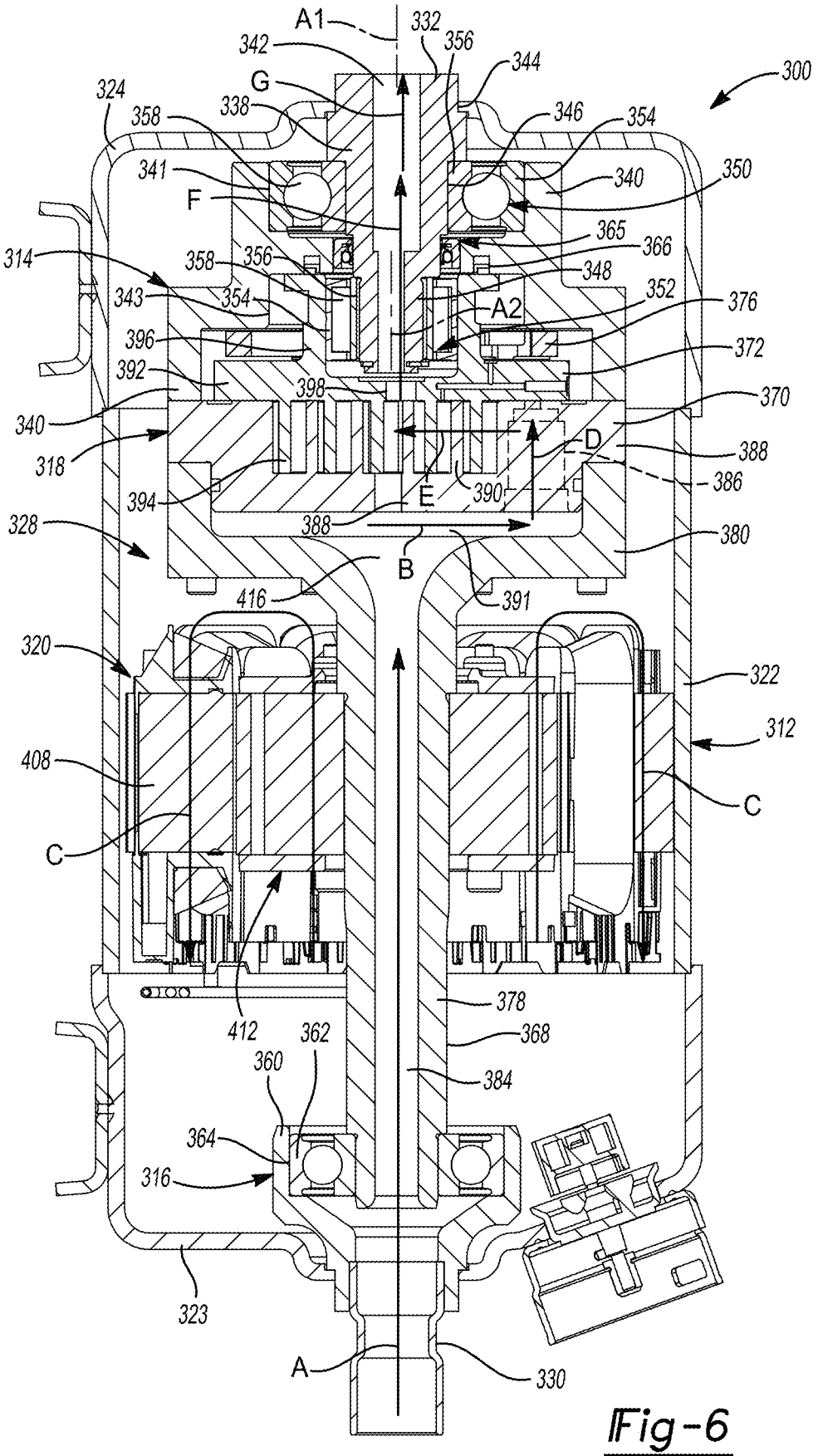
FIG. 6 is a cross-sectional view of another example compressor according to the present disclosure.
Figure 7:
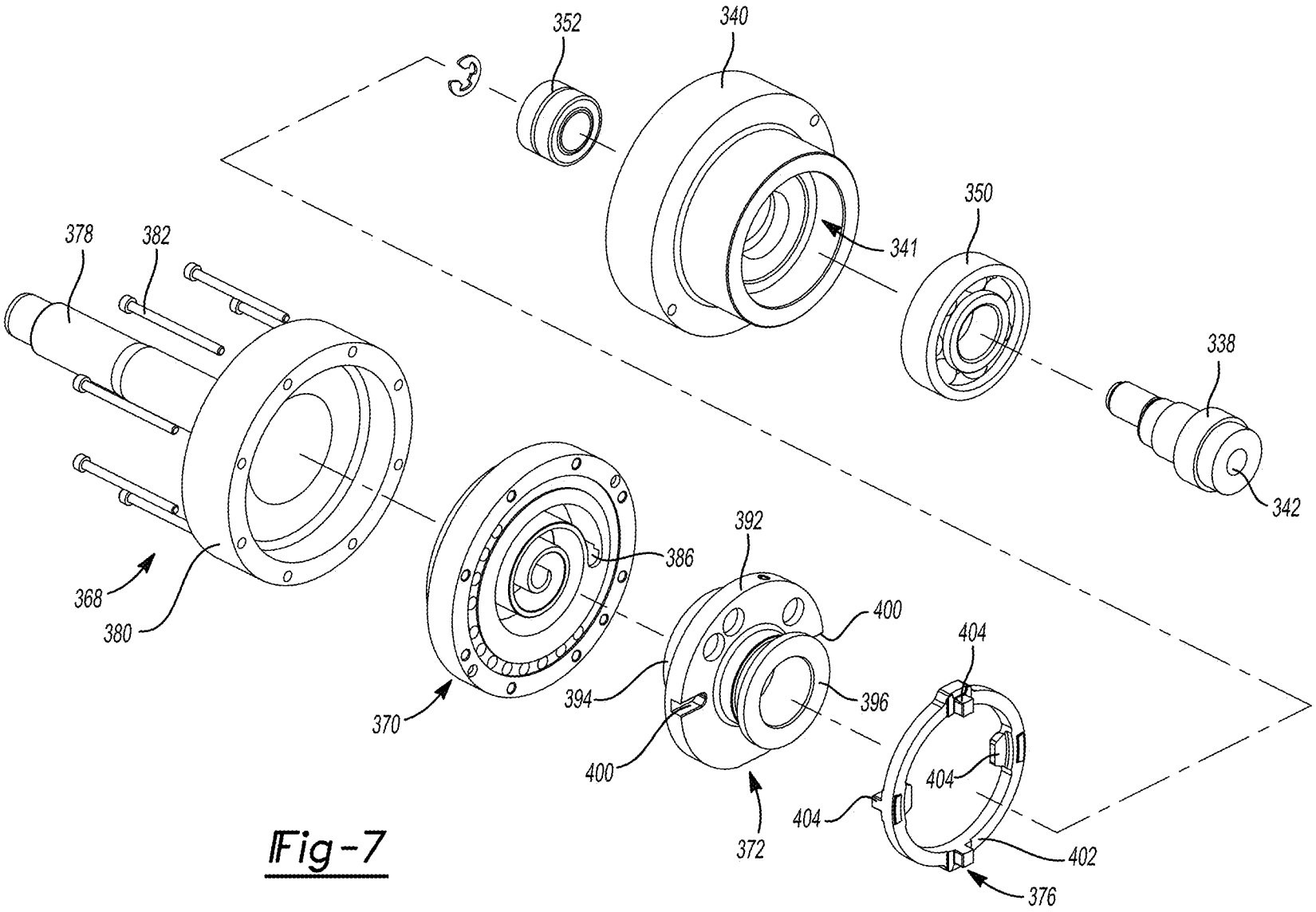
FIG. 7 is an exploded view of the compressor of FIG. 6.
Figure 8:
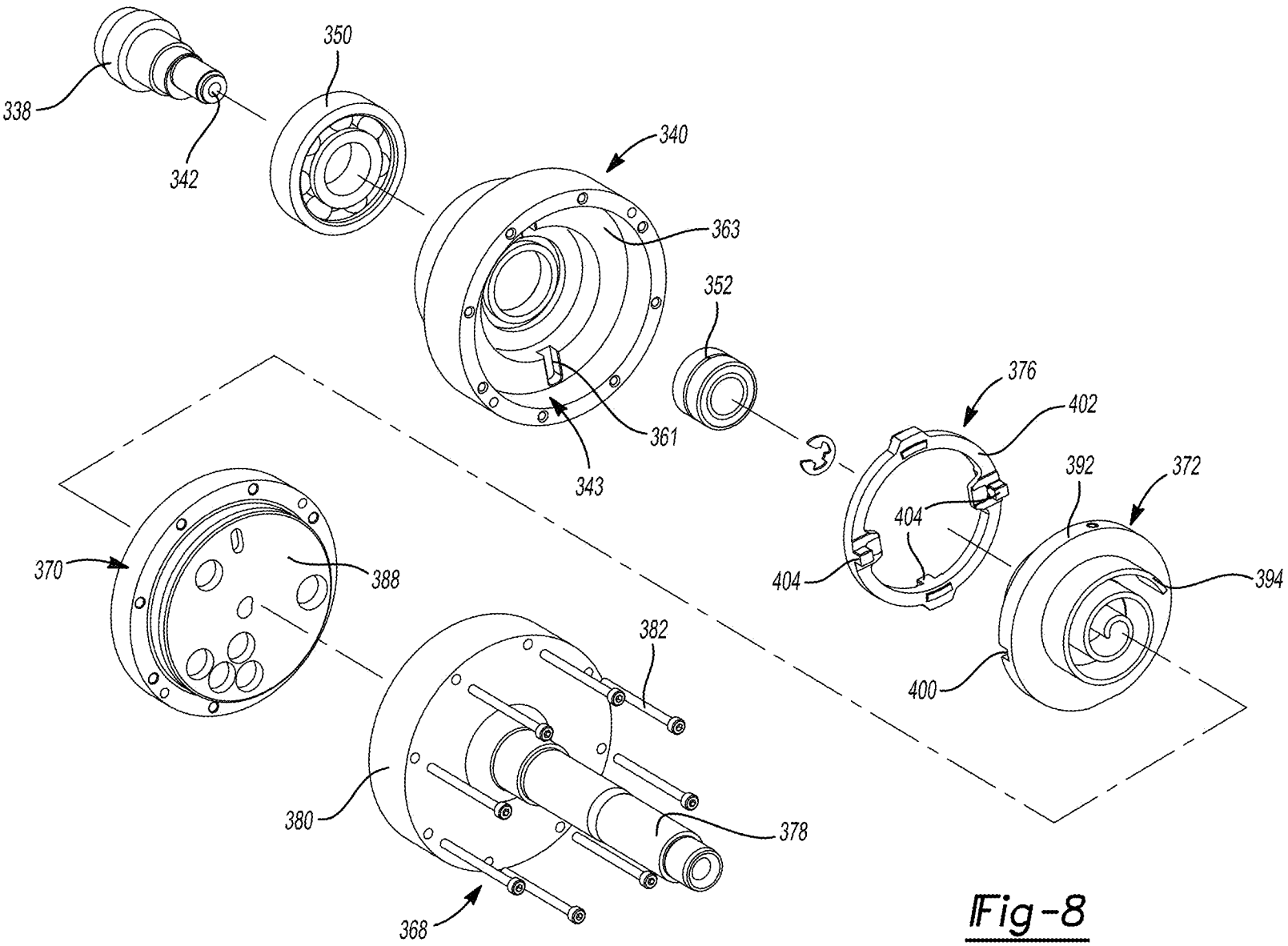
FIG. 8 is another exploded view of the compressor of FIG. 6.

Now referring to FIGS. 6-8, an example compressor 300 is provided that may include a shell assembly 312, a first bearing housing 314, a second bearing housing 316, a compression mechanism 318, and a motor assembly 320. The shell assembly 312 may include a shell body 322, a first end cap 323, and a second end cap 324. The shell body 322 may be generally cylindrical. The first and second end caps 323, 324 may be fixedly attached to opposing axial ends of the shell body 322.

The first end cap 323, the shell body 322, and the second end cap 324 may cooperate to define a suction chamber 328. The first and second bearing housings 314, 316, the compression mechanism 318, and the motor assembly 320 may be disposed within the suction chamber 328. The suction chamber 328 may receive suction-pressure working fluid from a suction inlet fitting 330 attached to the second end cap 324 or shell body 322. That is, suction-pressure working fluid (i.e., low-pressure working fluid) may enter the suction chamber 328 through the suction inlet fitting 330 and may be drawn into the compression mechanism 318 for compression therein. The compression mechanism 318 discharges compressed working fluid (i.e., discharge-pressure working fluid at a higher pressure than suction pressure) from the compressor 310 through a discharge outlet fitting 332 attached to the second end cap 324. For example, the compression mechanism 318 is in direct communication with the discharge outlet fitting, or compressor output, 332, without use of a discharge chamber. In some configurations, a discharge valve (for example, a check valve) may be disposed within the discharge outlet fitting that allows fluid to exit the discharge outlet fitting 332 and prevents fluid from entering the compressor 310 through the discharge outlet fitting 332.

The compressor 300 shown in the figures is a low-side compressor (i.e., the motor assembly 320 and at least a majority of the compression mechanism 318 are disposed in the suction chamber 328). It will be appreciated, however, that the principles of the present disclosure are applicable to high-side compressors (i.e., compressors having the compression mechanism 318 disposed in a discharge chamber).

The first bearing housing 314 may include a first bearing support member 338 and a second bearing support member 340. The first bearing support member 338 may be a generally cylindrical shaft or body having a discharge passage 342 extending axially therethrough. The first bearing support member 338 may be fixed relative to the shell assembly 312, forming a stationary shaft. For example, the first bearing support member 338 may be, monolithically formed with, or fixedly attached to, the discharge outlet fitting 332 and may extend through an opening 344 in the second end cap 324. In other configurations, the first bearing support member 338 may be attached to or integrally formed with the second end cap 324. The discharge passage 342 is in fluid communication with the discharge outlet fitting 332 and the compression mechanism 318 such that compressed working fluid discharged from the compression mechanism 318 flows through the discharge passage 342 into the discharge outlet fitting 332 and exits the compressor 300.

The first bearing support member 338 includes a first cylindrical surface 346 and a second cylindrical surface 348. The first cylindrical surface 346 may support a first bearing 350 and may define a first rotational axis A1. The second cylindrical surface 348 is eccentric relative to the first cylindrical surface 346 and defines a second rotational axis A2 that is parallel to and laterally offset from the first rotational axis A1. The second cylindrical surface 348 supports a second bearing 352.

The first and second bearings 350, 352 may be rolling element bearings that each may include an outer ring 354, an inner ring 356, and a plurality of rolling elements (e.g., spheres or cylinders) 358 disposed between the outer and inner rings 354, 356. The inner ring 356 of the first bearing 350 may be fixedly attached to the first cylindrical surface 346 of the first bearing support member 338. The outer ring 354 of the first bearing 350 may be attached to the second bearing support member 340. The inner ring 356 of the second bearing 352 may be fixedly attached to the second cylindrical surface 348 of the first bearing support member 338. Alternatively, a clearance between the inner ring 356 of the second bearing 352 and the second cylindrical surface 348 may achieve radial compliancy. The outer ring 354 of the second bearing 352 may be attached to the compression mechanism 318 (as will be described in more detail below). Alternatively, the second bearing 352 may be attached to the first bearing support member 338 or the compression mechanism 318 to provide radial compliance. Radial compliance would allow the second bearing 352 to separate sideways from the first bearing support member 338 or the compression mechanism 318, which may allow debris to pass through and improve durability and reliability.

The second bearing support member 340 may be an annular member having a first cavity 341 and a second cavity 343. The first cavity 341 may receive the first bearing 350. The second cavity 343 may receive a portion of the compression mechanism 318. The second bearing support member 340 may include a plurality of slots 361 (FIG. 8). For example, the slots 361 may be formed in an axially facing surface 363 (i.e., a surface that faces a direction parallel to the direction in which axes A1, A2 extend) of the second bearing support member 340. A plurality of radial drillings 367 may be disposed between the outer and inner surfaces of the bearing housing 316 to feed the excess oil accumulated at the cavity 328 into the suction stream A.

An annular seal 365 may be disposed within the second bearing support member 340 (e.g., axially between the first and second cavities 341, 343). The seal 365 may sealingly engage the second bearing support member 340 and the first bearing support member 338. Another annular seal 366 sealingly engages the second bearing support member 340 and a second scroll member 372. The seals 365, 366 prevent compressed working fluid (i.e., working fluid discharged from the compression mechanism 318) from flowing into the suction chamber 328 and intermediate pressure cavity 343, respectively.

The second bearing housing 316 may include an annular central hub 360. The hub 360 receives a third bearing 362. The hub 360 may also include a central aperture 364. The hub 360 may also include at least one radial drilling 363 to bring oil accumulated at the bottom of the cavity 328 into the suction passage 384.

The compression mechanism 318 may include a driveshaft 368, a first scroll member 370, the second scroll member 372, and an Oldham coupling (or Oldham ring) 376. The first and second scroll members 370, 372 cooperate to define fluid pockets (i.e., compression pockets) therebetween. The compression mechanism 318 is a co-rotating scroll compression mechanism in which the first scroll member 370 is a driving scroll member and the second scroll member 372 is a driven scroll member.

The driveshaft 368 may include a shaft portion 378 and a hub 380. The shaft portion 378 is rotatably supported by the third bearing 362 and extends through the motor assembly 320. The hub 380 extends radially outward from an axial end of the shaft portion 378. Fasteners 382 may extend through apertures in the hub 380, the first scroll member 370, and the second bearing support member 340 to rotationally fix the first scroll member 370 and the second bearing support member 340 relative to the driveshaft 368 (i.e., so that the first scroll member 370 and second bearing support member 340 rotate with the driveshaft 368 about the first rotational axis A1). The driveshaft 368 may include one or more apertures 384 through which suction-pressure working fluid from the suction inlet fitting 330 as well as from the suction chamber 328 can flow into a suction inlet opening 386 (FIG. 7) in the first scroll member 370. The suction inlet opening 386 may be an axially extending passage that terminates in a suction inlet in the first scroll member 370. The one or more apertures 384 define a suction passage in the driveshaft 368.

The first scroll member 370 may include a first end plate 388 and a first spiral wrap 390 extending from the first end plate 388. The suction inlet opening 386 may be disposed in the first end plate 388. The suction inlet opening 386 may be in fluid communication with the aperture 384 through a passage 391 defined by a space between the first end plate 388 and the hub 380. The passage 391 may be a radially extending passage that extends perpendicular to the aperture 384.

The second scroll member 372 may include a second end plate 392, a second spiral wrap 394 extending from one side of the second end plate 392, and a hub 396 extending from the opposite side of the second end plate 392. The second end plate 392 may include a discharge passage 398 that is in fluid communication with the discharge passage 342 in the first bearing support member 338.

The second scroll member 372 may be disposed within the second cavity 343 of the second bearing support member 340. The eccentric second cylindrical surface 348 of the first bearing support member 338 may be received within the hub 396 of the second scroll member 372. The hub 396 of the second scroll member 372 may be rotatably supported by the second bearing 352 and the eccentric second cylindrical surface 348 of the first bearing support member 338. In this manner, the second scroll member 372 is rotatable about the second rotational axis A2. As shown in FIG. 7, the second end plate 392 of the second scroll member 372 includes a plurality of slots 400.

The Oldham coupling 376 may be keyed to the second bearing support member 340 and the second scroll member 372. The Oldham coupling 376 may include an annular body 402 and keys 404. The keys 404 may be rectangular protrusions (i.e., rectangular prisms). The keys 404 on the same side of the annular body 402 may be disposed approximately 180 degrees apart from each other. The keys 404 extend axially from both opposing sides of the annular body 402.

The keys 404 are slidably received in respective slots 361, 400 of the second bearing support member 340 and second scroll member 372.

The Oldham coupling 376 transmits rotational energy of the driveshaft 368, through the second bearing support member 340 to the second scroll member 372 such that the driveshaft 368, first scroll member 370 and second bearing support member 340 rotate about the first rotational axis A1 causing synchronized rotation of the second scroll member 372 about the second rotational axis A2. The first and second spiral wraps 390, 394 are intermeshed with each other and cooperate to form a plurality of fluid pockets (i.e., compression pockets) therebetween. Rotation of the first scroll member 370 about the first rotational axis A1 and rotation of the second scroll member 372 about the second rotational axis A2 causes the fluid pockets to decrease in size as they move from a radially outer position to a radially inner position, thereby compressing the working fluid therein from the suction pressure to the discharge pressure.

The motor assembly 320 may be disposed within the suction chamber 328 and may include a motor stator 408 and a rotor 412. The motor stator 408 may be attached to the shell body 322 (e.g., via press fit, staking, and/or welding). The rotor 412 may be attached to the shaft portion 378 of the driveshaft 368 (e.g., via press fit, staking, and/or welding). The driveshaft 368 may be driven by the rotor 412 for rotation relative to the shell assembly 312 about the first rotational axis A1. The motor assembly 320 could be a fixed-speed motor, a multi-speed motor or a variable-speed motor.

Referring to FIG. 6, during compressor operation, a working fluid enters the inlet of the compressor 300 through the suction inlet fitting 330 (Arrow A). The working fluid may include both a refrigerant and an oil (for example, an oil mist). Since the compressor 300 is a sumpless compressor, the oil for lubrication of moving parts travels with the working fluid through the compressor 300. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, is pulled into the one or more apertures 384 defining a suction passage within the driveshaft 368. The working fluid moves through the driveshaft 368 towards the compression mechanism 318 (Arrow A). The working fluid travels through an output 416 of the aperture 384 and into the passage 391 defined by the space between the hub 380 and the first end plate 388 of the first scroll member 370 (Arrow B). A portion of the suction gas flowing through the passage 391 may exit into the suction pressure-chamber 328.

The portion of the working fluid pulled into the suction pressure chamber 328 is circulated through the motor assembly 320 to cool the motor assembly 320 (Arrows C). For example, the working fluid is circulated through the stator 408 and rotor 412 to absorb heat generated by operation of the rotor 412 and cool the motor assembly 320.

The main portion of the working fluid is received in the suction inlet opening 386 from the passage 391 (Arrow D). The suction inlet opening 386 in the compression mechanism 318 is an axially extending passage that extends perpendicularly from the passage 391. The working fluid is compressed within the pockets defined by the first spiral wrap 390 of the first, driving scroll 370 and the second spiral wrap 394 of the second, driven scroll 372 (Arrow E).

The compressed working fluid is discharged through the discharge passage 398 in the second end plate 392 of the second, driven scroll 372 (Arrow F). The compressed working fluid is at a high-pressure (i.e., compression pressure) and flows through the discharge passage 398 in the stationary bearing support member 338. The sealing assembly 365 isolates the compressed, high-pressure working fluid from the low-pressure suction pressure chamber 328. The compressed working fluid exits the compressor 300 through the discharge outlet fitting 332 (Arrow G).

In an alternative example, the compressor 300 may include an impeller (not shown), similar to impeller 204 in compressor 200, disposed between the hub 380 and the first end plate 388 of the first scroll 370, which defines the suction plenum. The impeller may define a passage, similar to the passage 391, that extends from the aperture 384 to the suction inlet opening 386 to streamline the gas flow from the aperture 384 to the suction inlet opening 386. The streamlined flow may reduce pressure drops between the aperture 384 and the compression mechanism 318. Additionally, the impeller provides pre-compression of the working fluid, where the working fluid is dynamically compressed prior to the compression mechanism 318 utilizing a centrifugal effect. The streamlined flow may, in certain conditions, provide a supercharging effect.

As described with respect to impeller 204, the impeller may be formed of a thermally insulated material. For example, the thermally insulated material may include, but is not limited to, ceramics, silicone, thermal insulating sprays, plastics, ceramics, or graphite. The thermally insulating impeller may reduce the heat transfer into the refrigerant flowing through the passage 391 toward the suction inlet opening 386. Reduction in the heat transfer may improve the volumetric efficiency of the refrigerant.

The impeller may be formed integrally with the first end plate 388 of the first scroll member 370 to create a single, monolithic piece. Accordingly, the position of the impeller relative to the first scroll member 370 may be fixed. Further, forming the impeller with the first end plate 388 creates easier and more reliable assembly of the compressor 300. Alternatively, the impeller may fit within a recessed portion in the first end plate 388 of the first scroll member 370. The recessed portion may locate and fix the position of the impeller relative to the hub 380 and the first scroll member 370.

Alternatively, the impeller may be formed integrally with the hub 380 or with the driveshaft 368.

During compressor 300 operation, the working fluid, at suction pressure, moves through the driveshaft 368 towards the compression mechanism 318. The working fluid travels through an output 416 of the suction passage 384 and into the passage defined by the impeller. A portion of the suction gas flowing through the passage may exit into the suction pressure-chamber 328. The main portion of the working fluid is received in the suction inlet opening 386 from the passage defined by the impeller. The working fluid is compressed within the pockets defined by the first spiral wrap 390 of the first, driving scroll 370 and the second spiral wrap 394 of the second, driven scroll 372.

Figure 9:
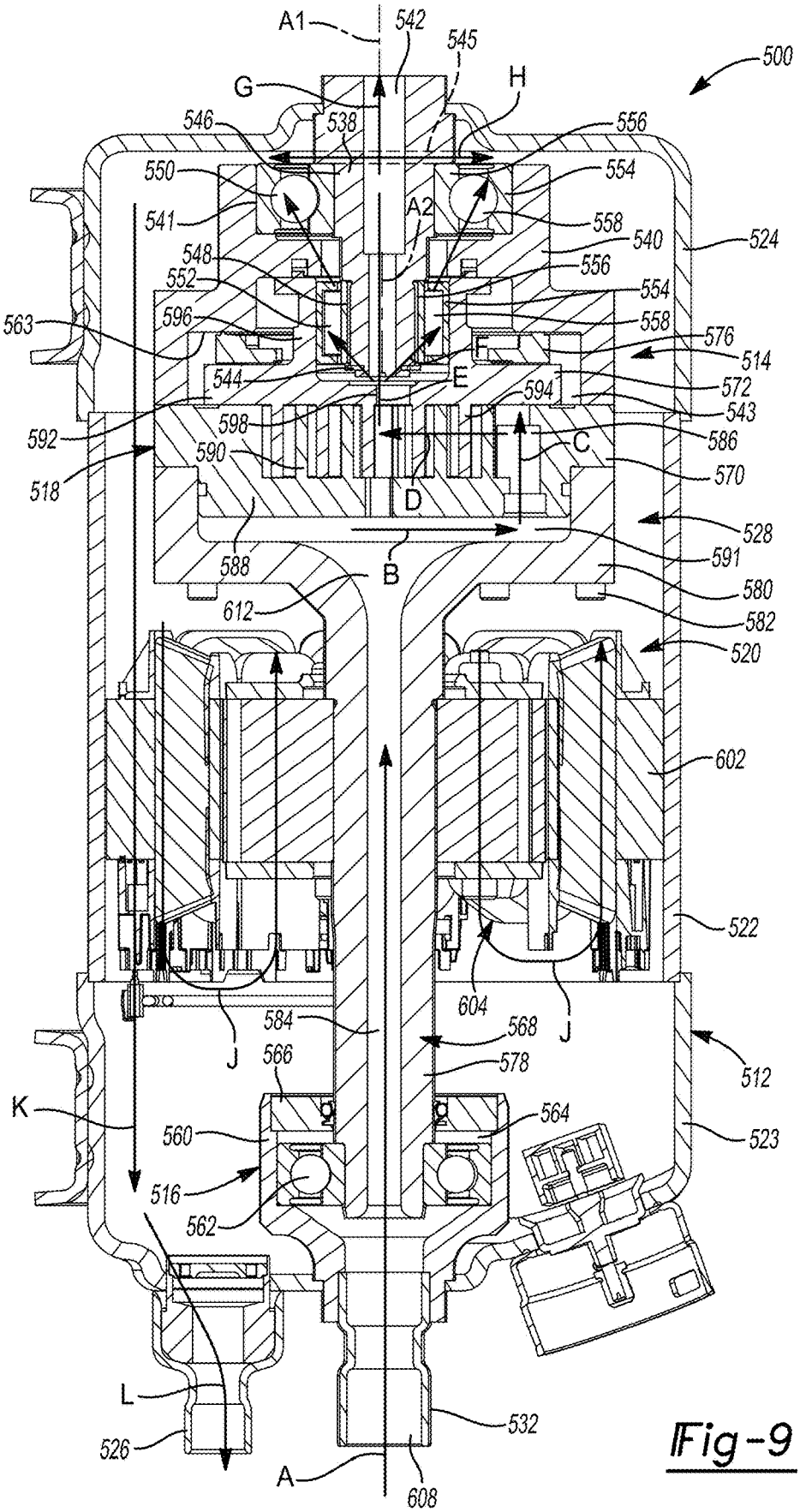
FIG. 9 is a cross-sectional view of another example compressor according to the present disclosure.
Figure 10:
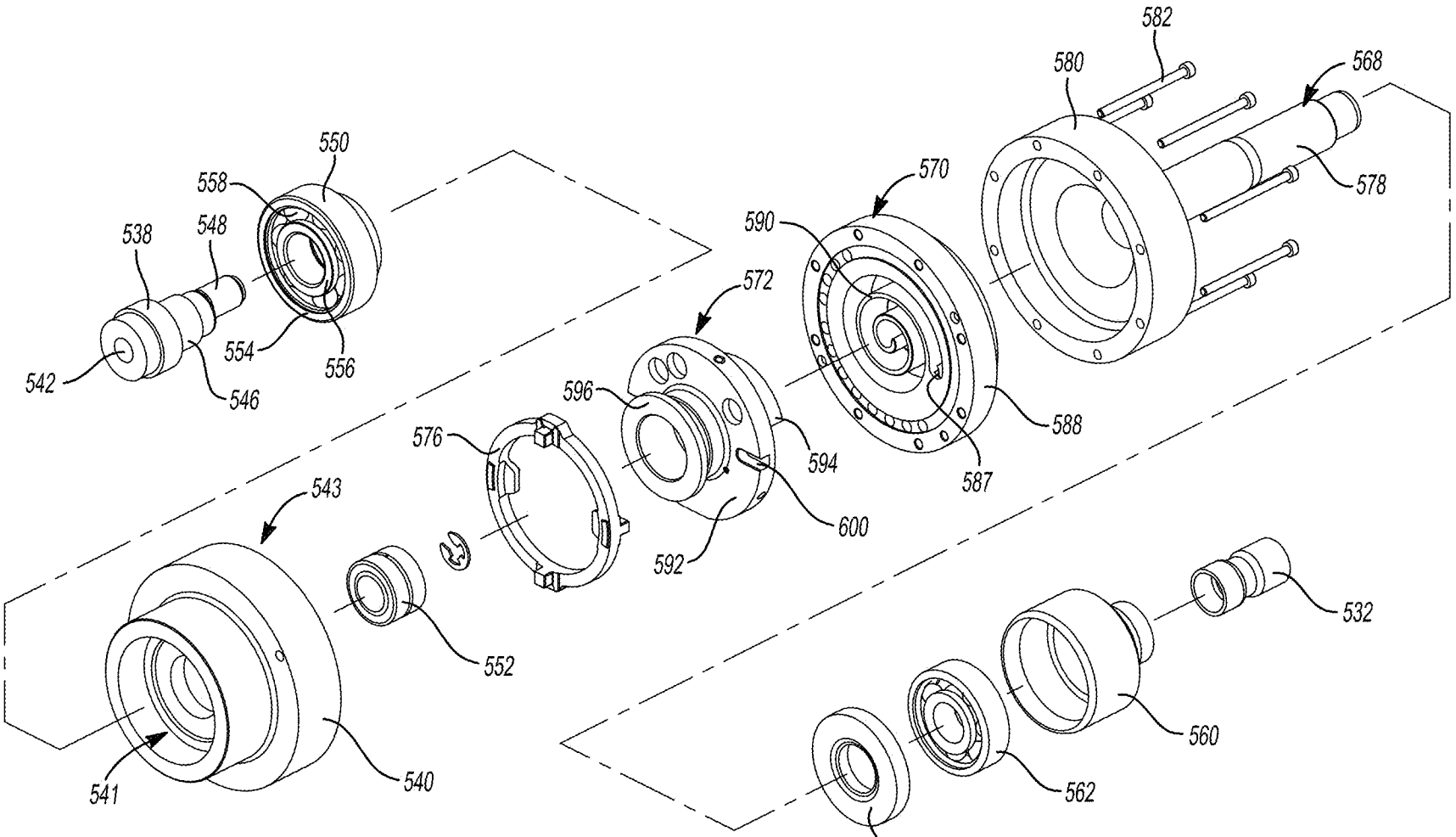
FIG. 10 is an exploded view of the compressor of FIG. 9.

Referring now to FIGS. 9 and 10, an example compressor 500 is provided that may include a shell assembly 512, a first bearing housing 514, a second bearing housing 516, a compression mechanism 518, and a motor assembly 520. The shell assembly 512 may include a shell body 522, a first end cap 523, and a second end cap 524. The shell body 522 may be generally cylindrical. The first and second end caps 523, 524 may be fixedly attached to opposing axial ends of the shell body 522.

The first end cap 523, the shell body 522, and the second end cap 524 may cooperate to define a discharge chamber 528. The first and second bearing housings 514, 516, the compression mechanism 518, and the motor assembly 520 may be disposed within the discharge chamber 528. The discharge chamber 528 may receive discharge-pressure working fluid from compression mechanism 518. That is, discharge-pressure working fluid (i.e., high-pressure working fluid) may enter the discharge chamber 528 from the compression mechanism 518. The compression mechanism 518 receives suction working fluid (i.e., suction-pressure working fluid at a lower pressure than discharge pressure) from a suction fitting 532 attached to the first end cap 523. For example, the compression mechanism 518 is in direct communication with the suction fitting 532, or compressor inlet, without use of a suction chamber. The discharge chamber 528 releases fluid from the compressor 500 through a discharge fitting 526 attached to the first end cap 523.

The compressor 500 shown in the figures is a high-side compressor (i.e., the motor assembly 520 and at least a majority of the compression mechanism 518 are disposed in the discharge chamber 528). It will be appreciated, however, that the principles of the present disclosure are applicable to low-side compressors (i.e., compressors having the compression mechanism 518 disposed in a suction chamber).

The first bearing housing 514 may include a first bearing support member 538 and a second bearing support member 540. The first bearing support member 538 may be a generally cylindrical shaft or body having a discharge passage 542 extending axially therethrough. The first bearing support member 538 may be fixed relative to the shell assembly 512, forming a stationary shaft. For example, the first bearing support member 538 may be fixedly attached to the second end cap 524. In other configurations, the first bearing support member 538 could be integrally formed with the second end cap 524. The discharge passage 542 is in fluid communication with the discharge outlet fitting 526 and the compression mechanism 518 such that compressed working fluid discharged from the compression mechanism 518 flows through the discharge passage 542 and exits the discharge passage 542 through a first series of apertures, or slots, 544 at a proximal end of the discharge passage 542, near the compression mechanism 518 and through a second series of apertures, or slots, 545 at a distal end of the discharge passage 542, near the second end cap 524.

The first bearing support member 538 includes a first cylindrical surface 546 and a second cylindrical surface 548. The first cylindrical surface 546 may support a first bearing 550 and may define a first rotational axis A1. The second cylindrical surface 548 is eccentric relative to the first cylindrical surface 546 and defines a second rotational axis A2 that is parallel to and laterally offset from the first rotational axis A1. The second cylindrical surface 548 supports a second bearing 552.

The first and second bearings 550, 552 may be rolling element bearings that each may include an outer ring 554, an inner ring 556, and a plurality of rolling elements (e.g., spheres or cylinders) 558 disposed between the outer and inner rings 554, 556. The inner ring 556 of the first bearing 550 may be fixedly attached to the first cylindrical surface 546 of the first bearing support member 538. The outer ring 554 of the first bearing 550 may be attached to the second bearing support member 540. The inner ring 556 of the second bearing 552 may be fixedly attached to the second cylindrical surface 548 of the first bearing support member 538. The outer ring 554 of the second bearing 552 may be attached to the compression mechanism 518 (as will be described in more detail below).

Alternatively, the second bearing 552 may be attached to the first bearing support member 538 or the compression mechanism 518 to provide radial compliance. Radial compliance would allow the second bearing 552 to separate sideways from the first bearing support member 538 or the compression mechanism 518, which may allow debris to pass through and improve durability and reliability. For example, the second bearing 552 may be arranged to provide radial compliance similarly or identically to the bearing disclosed in Assignee's commonly owned U.S. Publication No. 2021/0148362, the disclosure of which is incorporated by reference.

The second bearing support member 540 may be an annular member having a first cavity 541 and a second cavity 543. The first cavity 541 may receive the first bearing 550. The second cavity 543 may receive a portion of the compression mechanism 518. The second bearing support member 540 may include a plurality of slots (not shown). For example, the slots may be formed in an axially facing surface 563 (i.e., a surface that faces a direction parallel to the direction in which axes A1, A2 extend) of the second bearing support member 540.

Counter to the compressor 300 including the annular seal 365 that sealingly engages the second bearing support member 340 and the first bearing support member 338, the compressor 500 may not include seals along the first bearing support member 338 such that compressed working fluid (i.e., working fluid discharged from the compression mechanism 518) may flow from the discharge passage 542, through the first series of apertures 544 and the second series of apertures 545, and into the discharge chamber 528.

The second bearing housing 516 may include an annular central hub 560. The hub 560 receives a third bearing 562. The hub 560 may also include a central aperture 564. An annular seal 566 may be disposed within the hub 560 to prevent suction-pressure working fluid (i.e., working fluid from the suction inlet) from flowing into the discharge chamber 528. For example, the annular seal 566 may be pressed into the hub 560 of the second bearing housing 516 and may separate the third bearing 562 from the discharge chamber 528.

The compression mechanism 518 may include a driveshaft 568, a first scroll member 570, the second scroll member 572, and an Oldham coupling (or Oldham ring) 576. The first and second scroll members 570, 572 cooperate to define fluid pockets (i.e., compression pockets) therebetween. The compression mechanism 518 is a co-rotating scroll compression mechanism in which the first scroll member 570 is a driven scroll member and the second scroll member 572 is an idler scroll member.

The driveshaft 568 may include a shaft portion 578 and a hub 580. The shaft portion 578 is rotatably supported by the third bearing 562 and extends through the motor assembly 520. For example, the annular seal 566 may seal against shaft 578 and be press fit within the hub 560. The hub 580 extends radially outward from an axial end of the shaft portion 578. Fasteners 582 may extend through apertures in the hub 580, the first scroll member 570, and the second bearing support member 540 to rotationally fix the first scroll member 570 and the second bearing support member 540 relative to the driveshaft 568 (i.e., so that the first scroll member 570 and second bearing support member 540 rotate with the driveshaft 568 about the first rotational axis A1).

The driveshaft 568 may include one or more apertures 584 through which suction-pressure working fluid can flow into a suction inlet opening 586 in the first scroll member 570. The suction inlet opening 586 may be an axially extending passage that terminates in a suction inlet 587 in the first scroll member 570. The one or more apertures 584 define a suction passage in the driveshaft 568.

The first scroll member 570 may include a first end plate 588 and a first spiral wrap 590 extending from the first end plate 588. The suction inlet opening 586 may be disposed in the first end plate 588. The suction inlet opening 586 may be in fluid communication with the aperture 584 through a passage 591 defined by a space between the first end plate 588 and the hub 580. The passage 591 may be a radially extending passage that extends perpendicular to the aperture 584.

The second scroll member 572 may include a second end plate 592, a second spiral wrap 594 extending from one side of the second end plate 592, and a hub 596 extending from the opposite side of the second end plate 592. The second end plate 592 may include a discharge passage 598 that is in fluid communication with the discharge passage 542 in the first bearing support member 538.

The second scroll member 572 may be disposed within the second cavity 543 of the second bearing support member 540. The eccentric second cylindrical surface 548 of the first bearing support member 538 may be received within the hub 596 of the second scroll member 572. The hub 596 of the second scroll member 572 may be rotatably supported by the second bearing 552 and the eccentric second cylindrical surface 548 of the first bearing support member 538. In this manner, the second scroll member 572 is rotatable about the second rotational axis A2. As shown in FIG. 10, the second end plate 592 of the second scroll member 572 includes a plurality of slots 600.

As will be described in more detail below, the Oldham coupling 576 may be keyed to the second bearing support member 540 and the second scroll member 572. The Oldham coupling 576 transmits rotational energy of the driveshaft 568, first scroll member 570 and second bearing support member 540 to the second scroll member 572 such that rotation of the driveshaft 568, first scroll member 570 and second bearing support member 540 about the first rotational axis A1 causes corresponding rotation of the second scroll member 572 about the second rotational axis A2. The first and second spiral wraps 590, 594 are intermeshed with each other and cooperate to form a plurality of fluid pockets (i.e., compression pockets) therebetween. Rotation of the first scroll member 570 about the first rotational axis A1 and rotation of the second scroll member 572 about the second rotational axis A2 causes the fluid pockets to decrease in size as they move from a radially outer position to a radially inner position, thereby compressing the working fluid therein from the suction pressure to the discharge pressure.

The motor assembly 520 may be disposed within the discharge chamber 528 and may include a motor stator 602 and a rotor 604. The motor stator 602 may be attached to the shell body 522 (e.g., via press fit, staking, and/or welding). The rotor 604 may be attached to the shaft portion 578 of the driveshaft 568 (e.g., via press fit, staking, and/or welding). The driveshaft 568 may be driven by the rotor 604 for rotation relative to the shell assembly 512 about the first rotational axis A1. The motor assembly 520 could be a fixed-speed motor, a multi-speed motor or a variable-speed motor.

Referring to FIG. 9, during compressor operation, a working fluid enters an inlet 608 of the compressor 500 through the suction inlet fitting 532 (Arrow A). The working fluid may include both a refrigerant and an oil (for example, an oil mist). Since the compressor 500 is a sumpless compressor, the oil for heat transfer and lubrication of moving parts travels with the working fluid through the compressor 500. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, is pulled into the one or more apertures 584 defining a suction passage within the driveshaft 568. Because the annular seal 566 is provided in the hub 560 of the second bearing housing 516, the discharge-pressure working fluid does not leak into the suction stream at arrow A. Instead, the suction-pressure working fluid travels from the suction inlet fitting 532 directly through the aperture 584 in the driveshaft 568. The working fluid moves through the driveshaft 568 towards the compression mechanism 518 (Arrow A). The working fluid travels through an output 612 of the aperture 584 and into the passage 591 defined by the space between the hub 580 and the first end plate 588 of the first scroll member 570 (Arrow B). Unlike the compressor 300, a portion of the suction gas flowing through the passage 584 does not exit into the discharge pressure-chamber 528. Instead, in compressor 500, all of the suction gas flowing through the passage 584 is directed into the compression mechanism 518.

The working fluid is received in the suction inlet opening 586 from the passage 591 (Arrow C). The suction inlet opening 586 in the compression mechanism 518 is an axially extending passage that extends perpendicularly from the passage 591. The suction inlet opening 586 terminates at the suction inlet 587 in the first scroll member 570. The working fluid is compressed within the pockets defined by the first spiral wrap 590 of the first, driving scroll member 570 and the second spiral wrap 594 of the second, driven scroll member 572 (Arrow D).

The compressed working fluid is discharged through the discharge passage 598 in the second end plate 592 of the second, driven scroll 572 (Arrow E). A portion of the compressed working fluid exits into the discharge pressure chamber 528 before entering the discharge passage 542 in the stationary bearing support member 538 (Arrow F). The exiting portion of the compressed working fluid passes through the second bearing 552 and the first bearing 550, in that order.

The main portion of the compressed working fluid is at a high-pressure (i.e., compression pressure) and flows through the discharge passage 542 in the stationary bearing support member 538 (Arrow G). The compressed working fluid exits into the discharge pressure chamber 528 through at least one aperture 545 in a distal end of the stationary bearing support member 538 (Arrow H).

A portion of the working fluid in the discharge pressure chamber 528 is circulated through the motor assembly 520 to cool the motor assembly 520 (Arrows J). For example, the working fluid is circulated through the stator 602 and rotor 604 to absorb heat generated by operation of the stator 602 and rotor 604 and cool the motor assembly 520.

Another portion of the working fluid in the discharge pressure chamber 528 may bypass the motor assembly 520, passing between the motor assembly 520 and the shell 512

(Arrow K). The compressed working fluid exits the compressor 500 through the discharge outlet fitting 526 (Arrow L).

In an alternative example, the compressor 500 may include an impeller (not shown), similar to impeller 204 in compressor 200, disposed between the hub 580 and the first end plate 588 of the first scroll 570, which defines the suction plenum. The impeller may define a passage, similar to the passage 591, that extends from the aperture 584 to the suction inlet opening 586 to streamline the gas flow from the aperture 584 to the suction inlet opening 586. The streamlined flow may reduce pressure drops between the aperture 584 and the compression mechanism 518. Additionally, the impeller provides pre-compression of the working fluid, where the working fluid is dynamically compressed prior to the compression mechanism 518 utilizing a centrifugal effect. The streamlined flow may, in certain conditions, provide a supercharging effect.

As described with respect to impeller 204, the impeller may be formed of a thermally insulated material. For example, the thermally insulated material may include, but is not limited to, ceramics, silicone, thermal insulating sprays, plastics, ceramics, or graphite. The thermally insulating impeller may reduce the heat transfer into the refrigerant flowing through the passage toward the suction inlet opening 586. Reduction in the heat transfer may improve the volumetric efficiency of the refrigerant.

The impeller may be formed integrally with the first end plate 588 of the first scroll member 570 to create a single, monolithic piece. Accordingly, the position of the impeller relative to the first scroll member 570 may be fixed. Further, forming the impeller with the first end plate 588 creates easier and more reliable assembly of the compressor 500. Alternatively, the impeller may fit within a recessed portion in the first end plate 588 of the first scroll member 570. The recessed portion may locate and fix the position of the impeller relative to the hub 580 and the first scroll member 570. Alternatively, the impeller may be formed integrally with the hub 580 or with the driveshaft 568.

During compressor 500 operation, the working fluid, at suction pressure, moves through the driveshaft 568 towards the compression mechanism 518. The working fluid travels through the output 612 of the suction passage 584 and into the passage defined by the impeller. The working fluid is received in the suction inlet opening 586 from the passage defined by the impeller. The working fluid is compressed within the pockets defined by the first spiral wrap 590 of the first, driving scroll 570 and the second spiral wrap 594 of the second, driven scroll 572.

Figure 11:
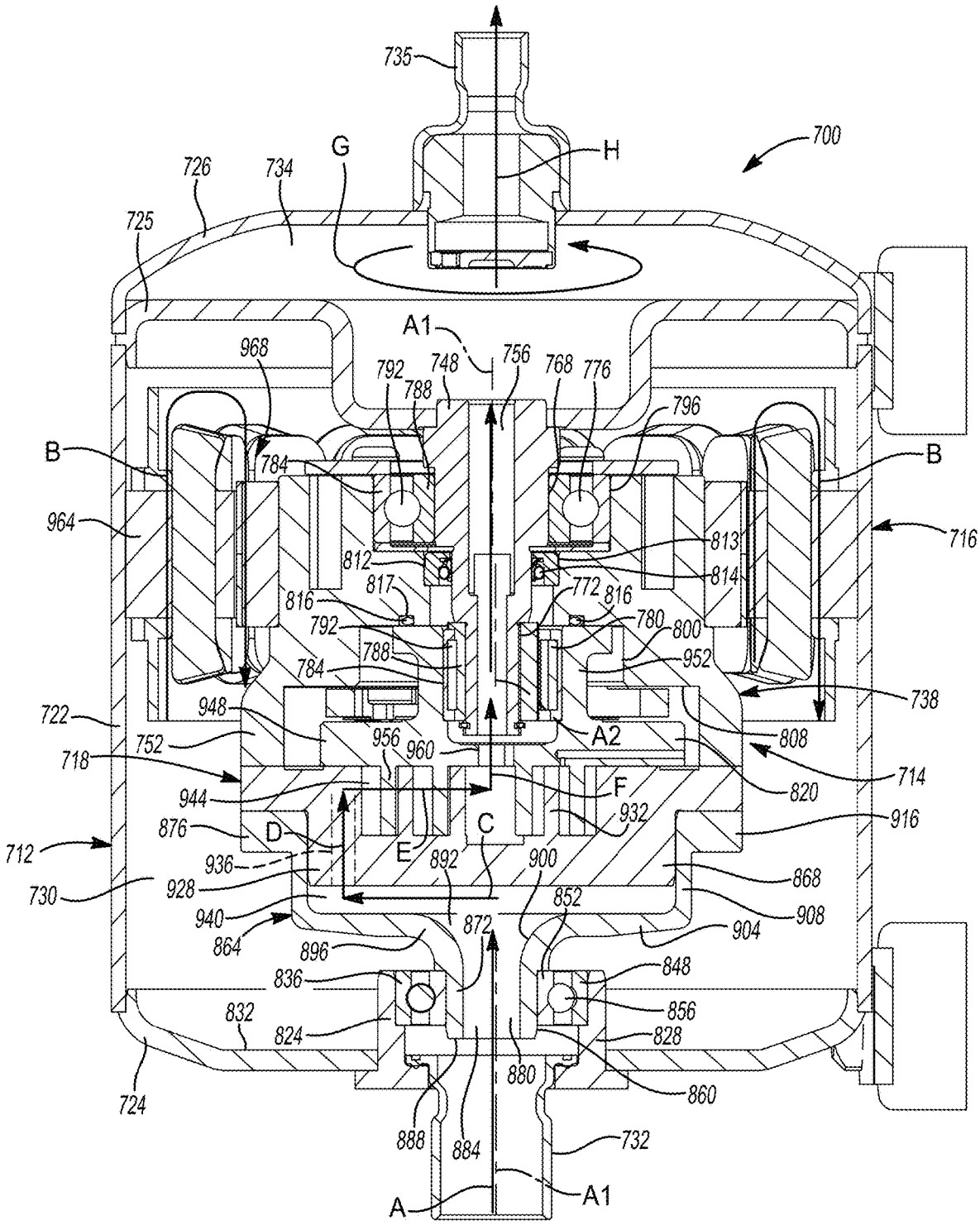
FIG. 11 is a cross-sectional view of another example compressor according to the present disclosure.
Figure 12:
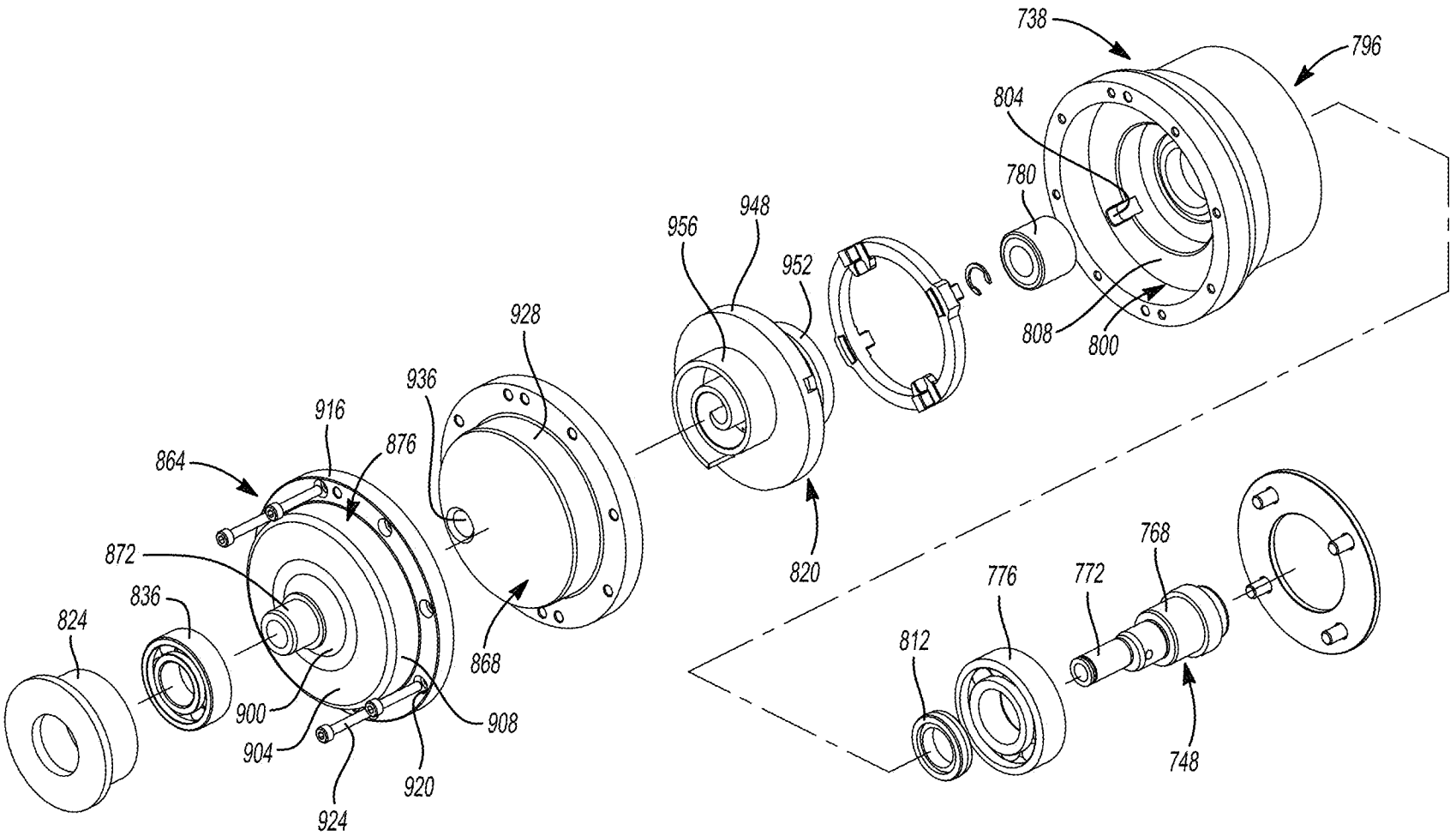
FIG. 12 is an exploded view of the compressor of FIG. 11.

Now referring to FIGS. 11 and 12, a compressor 700 is provided that may include a hermetic shell assembly 712, a bearing housing assembly 714, a motor assembly 716, and a compression mechanism 718.

The shell assembly 712 may generally form a compressor housing and may include a cylindrical shell 722, a first end cap 724 at one end of the shell 722, a partition 725, and a second end cap 726 at another end of the shell 722. The first end cap 724, the shell 722, and the partition 725 may cooperate to define a suction-pressure chamber 730. A suction gas inlet fitting 732 may be attached to the shell assembly 712 at an opening in the first end cap 724. Suction-pressure working fluid (i.e., low-pressure working fluid) may be drawn into the compression mechanism 718 via the suction gas inlet fitting 732 for compression therein.

As shown in FIGS. 11 and 12, the partition 725 and the second end cap 726 may cooperate to define a discharge-pressure chamber 734. The partition 725 may separate the discharge-pressure chamber 734 from the suction pressure chamber 730. A discharge gas outlet fitting 735 may be attached to the shell assembly 712 at another opening in the second end cap 726 and may communicate with the discharge-pressure chamber 734. Discharge-pressure working fluid (i.e., working fluid at a higher pressure than suction pressure) may be discharged by the compression mechanism 718 and may flow into the discharge-pressure chamber 734. The discharge-pressure working fluid in the discharge-pressure chamber 734 may exit the compressor 700 through the discharge-gas-outlet fitting 735. In some configurations, a discharge valve (e.g., a check valve) may be disposed within or adjacent the discharge-gas-outlet fitting 735 and may allow fluid to exit the discharge-pressure chamber 734 through the discharge-gas-outlet fitting 735 and prevent fluid from entering the discharge-pressure chamber 734 through the discharge-gas-outlet fitting 735.

The compressor 700 shown in the figures is a co-rotating, low-side scroll compressor with integrated motor (i.e., the motor assembly 716 and at least a majority of the compression mechanism 718 are at suction pressure). It will be appreciated, however, that the principles of the present disclosure are applicable to high-side compressors (i.e., compressors having the compression mechanism 718 disposed at discharge pressure).

The bearing housing assembly 714 may be disposed within the suction pressure chamber 730 and may include a main bearing housing 738. The main bearing housing 738 may include a first bearing support member 748 and a second bearing support member 752. The first bearing support member 748 may be a generally cylindrical shaft or body having a discharge passage 756 extending axially therethrough. The first bearing support member 748 may be fixed relative to the shell assembly 712, forming a stationary shaft. For example, the first bearing support member 748 may be fixedly attached to the partition 725 and may be in fluid communication with the discharge chamber 734. In other configurations, the first bearing support member 748 could be integrally formed with the partition 725. The discharge passage 756 is in fluid communication with the discharge chamber 734 and the compression mechanism 718 such that compressed working fluid discharged from the compression mechanism 718 flows through the discharge passage 756 and exits the discharge passage 756 at a distal end of the discharge passage 756, near the partition 725.

The first bearing support member 748 includes a first cylindrical surface 768 and a second cylindrical surface 772. The first cylindrical surface 768 may support a first bearing 776 and may define a first rotational axis A1. The second cylindrical surface 772 is eccentric relative to the first cylindrical surface 768 and defines a second rotational axis A2 that is parallel to and laterally offset from (i.e., non-collinear with) the first rotational axis A1. The second cylindrical surface 772 supports a second bearing 780.

The first and second bearings 776, 780 may be rolling element bearings that each may include an outer ring 784, an inner ring 788, and a plurality of rolling elements (e.g., spheres or cylinders) 792 disposed between the outer and inner rings 784, 788. The inner ring 788 of the first bearing 776 may be fixedly attached to the first cylindrical surface 768 of the first bearing support member 748. The outer ring 784 of the first bearing 776 may be attached to the second bearing support member 752. The inner ring 788 of the second bearing 780 may be fixedly attached to the second cylindrical surface 772 of the first bearing support member 748 or alternatively, positioned over the second cylindrical surface 772 with a radial clearance to achieve radial compliance. The outer ring 784 of the second bearing 780 may be attached to the compression mechanism 718 (as will be described in more detail below). Alternatively, the second bearing 780 may be attached to the first bearing support member 748 or the compression mechanism 718 to provide radial compliance. Radial compliance would allow the second bearing 780 to separate sideways from the first bearing support member 748 or the compression mechanism 718, which may allow debris to pass through and improve durability and reliability.

The second bearing support member 752 may be an annular member having a first cavity 796 and a second cavity 800. The first cavity 796 may receive the first bearing 776. The second cavity 800 may receive a portion of the compression mechanism 718 and the second bearing 780. The second bearing support member 752 may include a plurality of slots 804 (FIG. 12). For example, the slots 804 may be formed in an axially facing surface 808 (i.e., a surface that faces a direction parallel to the direction in which axes A1, A2 extend) of the second bearing support member 752. An annular seal 812 may be disposed within the second bearing support member 752 (e.g., axially between the first and second cavities 796, 800). The seal 812 may sealingly engage the second bearing support member 752 and the first bearing support member 748. The seal 812 may include a housing 813 and a sealing member 814. The housing 813 is press-fitted within the second bearing support member 752 such that an outer diametrical surface of the housing 813 is sealingly engaged with an inner diametrical surface of the second bearing support member 752. The sealing member 814 is disposed within the housing 813 and is sealingly engaged with an outer diametrical surface of the first bearing support member 748. In this way, fluid discharged from the fluid pockets of the compression mechanism 718 is prevented from flowing to the bearing 776 and to the suction pressure chamber 730.

Another annular seal 816 sealingly engages the second bearing support member 752 and a second scroll member 820. Seal 816 may be disposed within a groove 817 formed in the second bearing support member 752 and may sealingly and slidably engage the second scroll member 820 to form an annular biasing chamber 731. The seal 816 keeps the biasing chamber 731 sealed off from discharge fluid while still allowing relative movement between the second bearing support member 752 and the second scroll member 820.

The first end cap 724 may include a second bearing housing 824. The second bearing housing 824 may be fixed to the first end cap 724. Alternatively, the second bearing housing 824 may be formed integrally and monolithically with the end cap 724. The second bearing housing 824 may include an annular central hub 828. The hub 828 may project from an internal surface 832 of the first end cap 724. The hub 828 receives a third bearing 836.

The third bearing 836 may be a rolling element bearing that may include an outer ring 848, an inner ring 852, and a plurality of rolling elements (e.g., spheres or cylinders) 856 disposed between the outer and inner rings 848, 852. The inner ring 848 may be fixedly attached to a cylindrical surface 860 of a driveshaft 864. The outer ring 848 may be attached to the hub 828.

The compression mechanism 718 may include the driveshaft 864. The compression mechanism 718 may be disposed within the suction pressure chamber 730. The compression mechanism 718 may include a first compression member and a second compression member that cooperate to define fluid pockets (i.e., compression pockets) therebetween. For example, the compression mechanism 718 may be a co-rotating scroll compression mechanism in which the first compression member is a first scroll member (i.e., a driver scroll member) 868 and the second compression member is the second scroll member (i.e., a driven scroll member) 820.

The driveshaft 864 may include a shaft section 872 and a hub 876. The shaft section 872 may include a suction passage 880. The suction passage 880 provides fluid communication between the suction gas inlet fitting 732 and the compression mechanism 718. An inlet 884 of the suction passage 880 may be disposed at or near a first end 888 of the shaft section 872 adjacent the suction gas inlet fitting 732 or the suction-pressure chamber 730. An outlet 892 of the suction passage 880 may be disposed at or near a second end 896 of the shaft section 872 adjacent to the compression mechanism 718. The second end 896 of the shaft section 872 may include a flange 900 for engaging the shaft section 872 with the hub 876. The suction passage 880 may be coated in a thermal insulation coating to prevent preheat of the working fluid. For example, the thermal insulation coating may include, but is not limited to, ceramics, silicone or thermal insulating sprays.

A radial portion 904 of the hub 876 may engage with the second end 896 of the shaft section 872. The hub 876 may further include an axial portion 908 and a flange 916. The radial portion 904 extends in a radial direction from the second end 896 of the shaft section 872 (in a direction perpendicular to a rotational axis A1 of driveshaft 864) and the axial portion 908 extends in an axial direction from a periphery of the radial portion 904 (in a direction parallel to a rotational axis A1 of driveshaft 864). The flange 916 extends in a radial direction from an end of the axial portion 908 and includes a plurality of pin housings 920. As shown in FIG. 12, the pin housings 920 are spaced apart from each other and are circumferentially disposed around the flange 916. Each pin 924 extending from the main bearing housing 738 is received in a respective pin housing 920, thereby coupling the main bearing housing 738 and the hub 876 to each other. In this manner, rotation of the main bearing housing 738 causes corresponding rotation of the driveshaft 864 about the rotational axis A1 of the driveshaft 864.

The first scroll member 868 may include a first end plate 928 and a first spiral wrap 932 extending from the first end plate 928. The first end plate 928 is disposed within and fixed to the flange 916 of the driveshaft 864 such that the flange 916 surrounds the first spiral wrap 928. In some configurations, the first scroll member 868 and the driveshaft 864 may be a single component as opposed to two separate components fixed to each other. The first end plate 928 may include an axially extending passage 936. A radially extending passage 940 is formed between the first end plate 928 and the hub 876 and extends from the outlet 892 of the suction passage 880 to the axially extending passage 936. The axially extending passage 936 extends from an end of the radially extending passage 940 to a suction inlet 944 of the first scroll member 868. In this way, suction gas flowing through the suction passage 880 may flow through the passages 936, 940 and into an outermost pocket of the fluid pockets via the suction inlet 944. A portion of the suction gas flowing through the passages 936, 940 may exit into the suction pressure chamber 730.

The second scroll member 820 defines a second rotational axis A2 that is parallel to the rotational axis A1 and offset from the rotational axis A1. The second scroll member 820 may include a second end plate 948, a cylindrical hub 952 extending from one side of the second end plate 948, and a second spiral wrap 956 extending from the opposite side of the second end plate 948.

The first bearing support member 748 may form a stationary crank having the discharge passage 756. The proximal end of the first bearing support member 748 may extend through the bearing 780 and into the hub 952. The passage 756 provides fluid communication between the compression mechanism 718 and the discharge-pressure chamber 734. The discharge passage 756 may be coated with a thermal insulation coating to prevent heat transfer from the compressed working fluid to the compressor parts. For example, the thermal insulation coating may include, but is not limited to, ceramics, silicone or thermal insulating sprays.

The first and second spiral wraps 932, 956 are intermeshed with each other and cooperate to form a plurality of fluid pockets (i.e., compression pockets) therebetween. Rotation of the first scroll member 868 about the rotational axis A1 and rotation of the second scroll member 820 about the second rotational axis A2 causes the fluid pockets to decrease in size as they move from a radially outer position to a radially inner position, thereby compressing the working fluid therein from the suction pressure to the discharge pressure.

The second end plate 948 may be disposed axially between the first end plate 928 and the main bearing housing 738. The second end plate 948 may include a biasing passage (not shown) that provides fluid communication between an intermediate-pressure compression pocket and the biasing chamber.

The second end plate 948 may include a discharge passage 960. The discharge passage 960 extends through the second end plate 948 and provides fluid communication between a radially innermost one of the fluid pockets and the discharge-gas-outlet fitting 735 (via the passage 756 in the first bearing support member 748). A discharge valve (e.g., a reed valve or other check valve) may be disposed within or adjacent the discharge passage 960 or at the proximal end of the first bearing support member 748. The discharge valve allows working fluid to be discharged from the compression mechanism 718 through the discharge passage 960 and into the first bearing support member 748 and prevents working fluid in the first bearing support member 748 from flowing back into to the compression mechanism 718. The discharge gas flowing out of the discharge passage 960 may flow through the passage 756 of the first bearing support member 748, into the discharge-pressure chamber 734 and out of the compressor 700 through the discharge-gas-outlet fitting 735.

The motor assembly 716 may be disposed within the suction pressure chamber 730 and may include a motor stator 964 and a rotor 968. The motor stator 964 may be attached to the shell 722 (e.g., via press fit, staking, and/or welding). The rotor 968 may be attached to the second bearing support member 752 (e.g., via press fit, staking, epoxy, glue, adhesive, and/or welding). The second bearing support member 752 may be driven by the rotor 968 and may be supported by bearings 776 and 836 for rotation relative to the shell assembly 712. The bearing 776 may be fixed to the first bearing support member 748 and the second bearing support member 752. The bearing 836 may be fixed to the second bearing housing 824 and the driveshaft 864. In some configurations, the motor assembly 716 is a variable-speed motor. In other configurations, the motor assembly 716 could be a multi-speed motor or a fixed-speed motor.

Attaching the motor stator 964 to the shell 722 and the rotor 968 to the second bearing support member 752 positions the motor assembly 716 about the second bearing support member 752, instead of about the driveshaft 864. Placement of the motor assembly 716 about the second bearing support member 752 reduces the compressor 700 footprint. The shaft section 872 of the driveshaft 864 may be reduced in length, reducing an overall length of the compressor 700. A reduction in the footprint of the compressor 700 reduces the thermal communication of the suction gas with other parts of the compressor 700, reducing preheat.

Following the arrows in FIG. 11, during use, a working fluid enters the compressor 700 through the suction gas inlet fitting 732 in the first end cap 724 of the compressor 700 (Arrow A). The working fluid may include both a refrigerant and an oil (for example, an oil mist). Since the compressor 700 is a sumpless compressor, the oil for heat transfer and lubrication of moving parts travels with the working fluid through the compressor 700. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, enters the suction passage 880 within the driveshaft 864. A portion of the working fluid, at suction pressure enters the suction pressure chamber 730 through the bearing 836 in the second bearing housing 824. The portion of the working fluid in the suction pressure chamber 730 may circulate through the motor assembly 716 to transfer heat away from the motor assembly 716 and cool the rotor 968 and stator 964 (Arrow B).

A main portion of the working fluid, at suction pressure, is pulled through the suction passage 880 within the driveshaft 864 (Arrow A). The working fluid moves through the driveshaft 864 towards the compression mechanism 718. The working fluid travels through the output 892 of the suction passage 880 and into the radially extending passage 940 defined by the space between the hub 876 and the first end plate 928 (Arrow C). A portion of the suction gas flowing through the passages 880, 940 may exit into the suction pressure chamber 730.

The working fluid is received in the axially extending passage 936 from the radially extending passage 940 (Arrow D). The axially extending passage 936 provides an entrance into the suction inlet 944 in the compression mechanism 718. The working fluid is compressed within the pockets defined by the first spiral wrap 932 of the first, driving scroll 868 and the second spiral wrap 956 of the second, driven scroll 820 (Arrow E).

The compressed working fluid is discharged through the discharge passage 960 in the second end plate 948 of the second, driven scroll 820 (Arrow F). The compressed working fluid is at a high-pressure (i.e., discharge pressure) and flows through the discharge passage 756 in the first bearing support member 748. The annular seals 812, 816 isolate the compressed, high-pressure working fluid from the suction pressure chamber 730 and intermediate chamber 731. The compressed working fluid enters the discharge-pressure chamber 734 (Arrow G). The compressed working fluid exits the compressor 700 through the discharge gas outlet fitting 735 (Arrow H).

In an alternative example, the compressor 700 may include an impeller (not shown), similar to impeller 204 in compressor 200, disposed between the flange 900 and the first end plate 928 of the first scroll member 868, which defines the suction plenum. The impeller may define a passage, similar to the passage 940, which extends from the output 892 to the axially extending passage 936, to streamline the gas flow from the output 892 to the axially extending passage 936. The streamlined flow may reduce pressure drops between the output 892 and the compression mechanism 718. Additionally, the impeller provides pre-compression of the working fluid, where the working fluid is dynamically compressed prior to the compression mechanism 718 utilizing a centrifugal effect. The streamlined flow may, in certain conditions, provide a supercharging effect.

As described with respect to impeller 204, the impeller may be formed of a thermally insulated material. For example, the thermally insulated material may include, but is not limited to, ceramics, silicone, thermal insulating sprays, plastics, ceramics, or graphite. The thermally insulating impeller may reduce the heat transfer into the refrigerant flowing through the passage in the impeller toward the axially extending passage 936 and compression mechanism 718. Reduction in the heat transfer may improve the volumetric efficiency of the refrigerant.

The impeller may be formed integrally with the first end plate 928 of the first scroll member 868 to create a single, monolithic piece. Accordingly, the position of the impeller relative to the first scroll member 868 may be fixed. Further, forming the impeller with the first end plate 928 creates easier and more reliable assembly of the compressor 700. Alternatively, the impeller may fit within a recessed portion in the first end plate 928 of the first scroll member 868. The recessed portion may locate and fix the position of the impeller relative to the flange 900 and the first scroll member 868. Alternatively, the impeller may be formed integrally with the hub 876 or with the driveshaft 864.

During compressor 700 operation, the working fluid, at suction pressure, moves through the driveshaft 864 towards the compression mechanism 718. The working fluid travels through an output 892 of the suction passage 880 and into the passage defined by the impeller. The working fluid is received in the axially extending passage 936 from the passage defined by the impeller. The working fluid is compressed within the pockets defined by the first spiral wrap 932 of the first, driving scroll 868 and the second spiral wrap 956 of the second, driven scroll 820.

Figure 13:
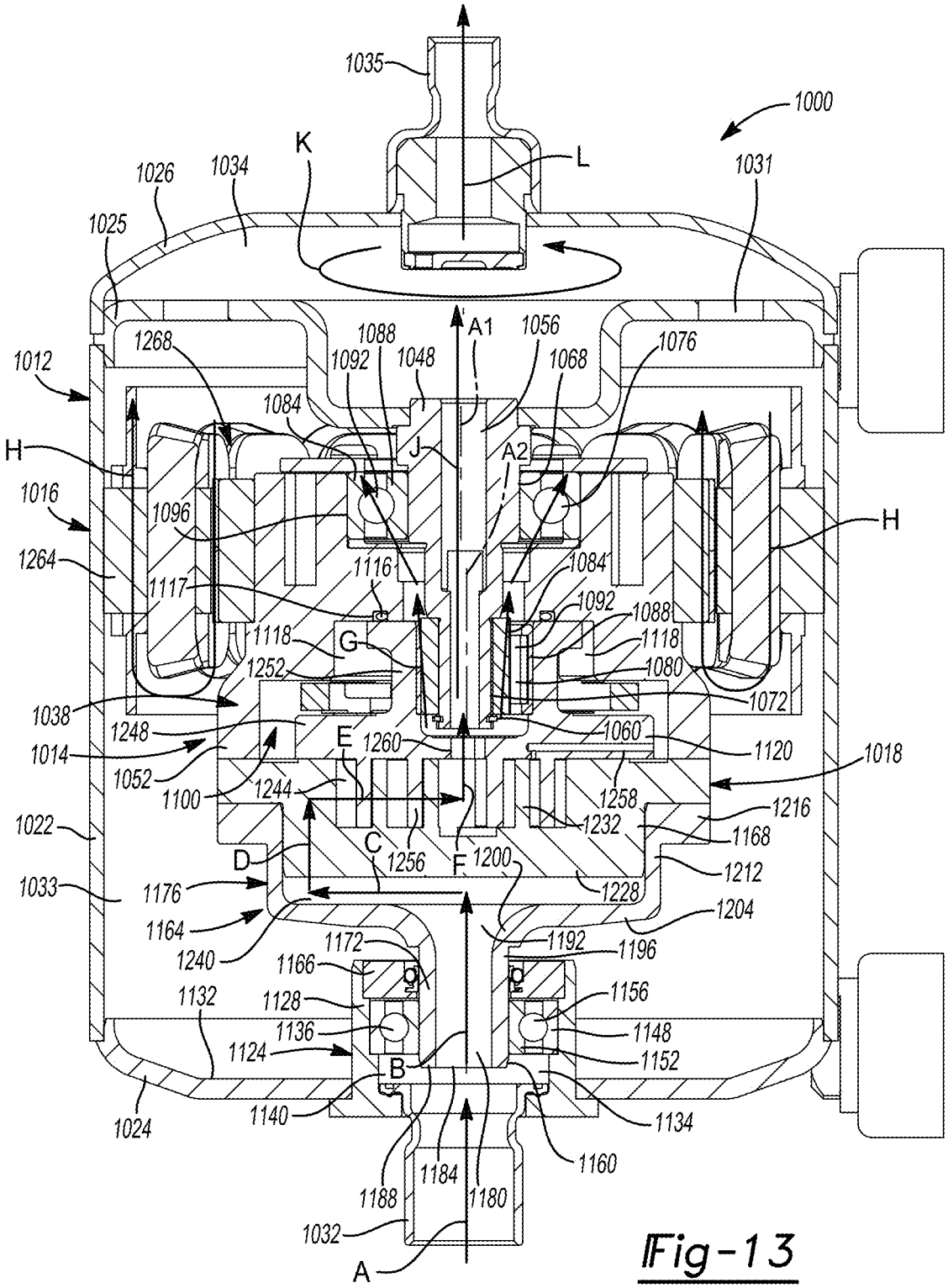
FIG. 13 is a cross-sectional view of another example compressor according to the present disclosure.
Figure 14:
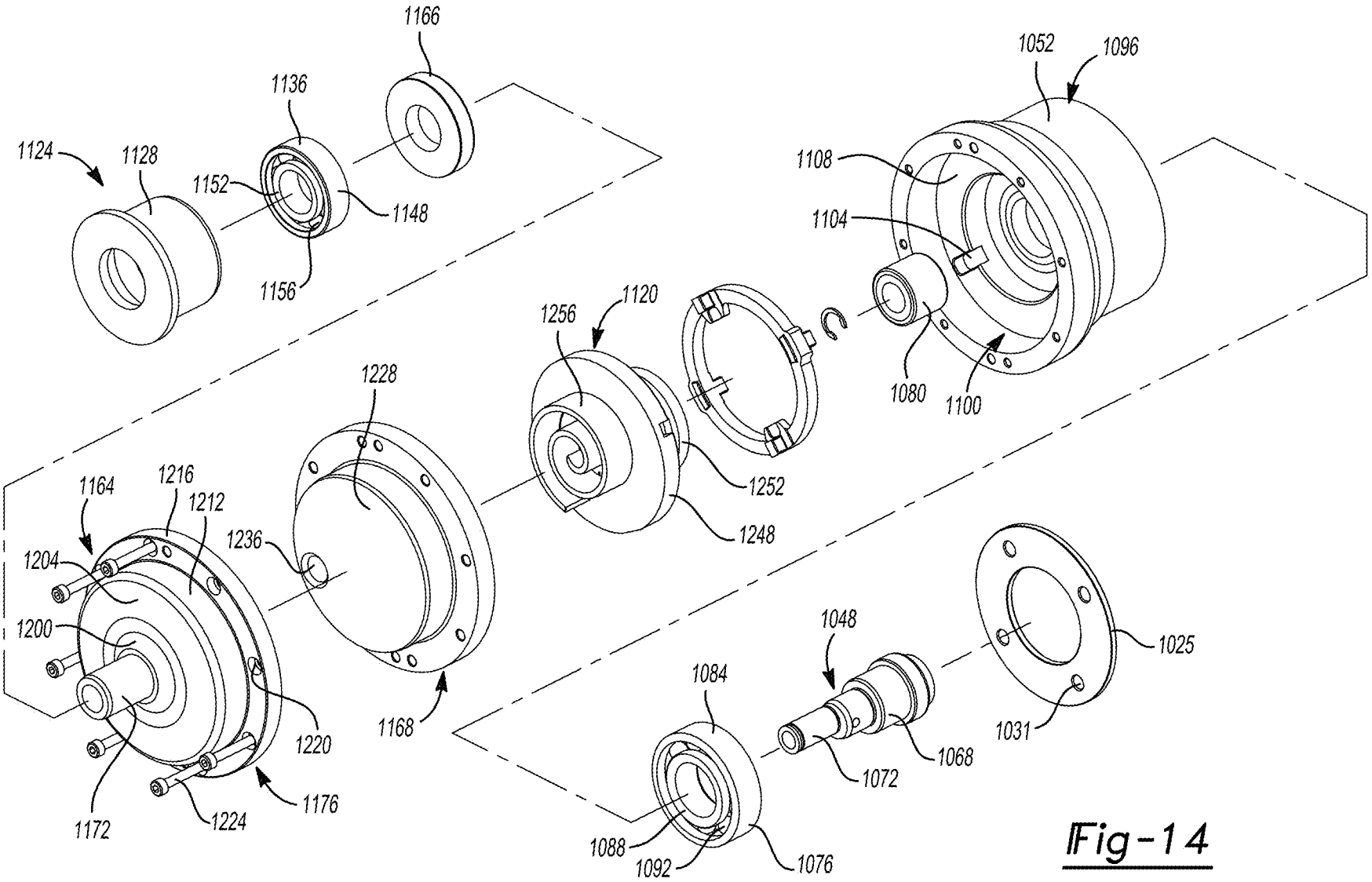
FIG. 14 is an exploded view of the compressor of FIG. 13.

Now referring to FIGS. 13 and 14, a compressor 1000 is provided that may include a hermetic shell assembly 1012, a bearing housing assembly 1014, a motor assembly 1016, and a compression mechanism 1018.

The shell assembly 1012 may generally form a compressor housing and may include a cylindrical shell 1022, a first end cap 1024 at one end of the shell 1022, a partition 1025, and a second end cap 1026 at another end of the shell 1022. A suction gas inlet fitting 1032 may be attached to the shell assembly 1012 at an opening in the first end cap 1024. Suction-pressure working fluid (i.e., low-pressure working fluid) may be drawn into the compression mechanism 1018 via the suction gas inlet fitting 1032 for compression therein.

As shown in FIGS. 13 and 14, the partition 1025, the shell 1022, and the first end cap 1024 may cooperate to define an internal space 1033. The partition 1025 and the second end cap 1026 may cooperate to define a discharge-pressure chamber 1034. The partition 1025 may include apertures 1031 (FIG. 14) that fluidly connect the discharge-pressure chamber 1034 with the internal space 1033. A discharge gas outlet fitting 1035 may be attached to the shell assembly 1012 at an opening in the second end cap 1026 and may communicate with the discharge-pressure chamber 1034. Discharge-pressure working fluid (i.e. working fluid at a higher pressure than suction pressure) may be discharged by the compression mechanism 1018 and may flow into the discharge-pressure chamber 1034. The discharge-pressure working fluid may flow into the internal space 1033 through the apertures 1031, such that the internal space 1033 is at discharge pressure. The main portion of the discharge-pressure working fluid in the discharge-pressure chamber 1034 may exit the compressor 1000 through the discharge-gas-outlet fitting 1035.

In some configurations, a discharge valve (e.g., a check valve) may be disposed within or adjacent the discharge-gas-outlet fitting 1035 and may allow fluid to exit the discharge-pressure chamber 1034 through the discharge-gas-outlet fitting 1035 and prevent fluid from entering the discharge-pressure chamber 1034 through the discharge-gas-outlet fitting 1035.

The compressor 1000 shown in the figures is a co-rotating, high-side, integrated-scroll compressor (i.e., the motor assembly 1016 and at least a majority of the compression mechanism 1018 are at discharge pressure). It will be appreciated, however, that the principles of the present disclosure are applicable to low-side compressors (i.e., compressors having the compression mechanism 1018 disposed at suction pressure).

The bearing housing assembly 1014 may be disposed within the internal space 1033 (at discharge pressure) and may include a main bearing housing 1038. The main bearing housing 1038 may include a first bearing support member 1048 and a second bearing support member 1052. The first bearing support member 1048 may be a generally cylindrical shaft or body having a discharge passage 1056 extending axially therethrough. The first bearing support member 1048 may be fixed relative to the shell assembly 1012, forming a stationary shaft. For example, the first bearing support member 1048 may be fixedly attached to the partition 1025 and may be in fluid communication with the discharge chamber 1034. In other configurations, the first bearing support member 1048 could be integrally formed with the partition 1025. The discharge passage 1056 is in fluid communication with the discharge chamber 1034, the internal space 1033, and the compression mechanism 1018 such that compressed working fluid discharged from the compression mechanism 1018 flows through the discharge passage 1056 and exits the discharge passage 1056 through a series of apertures, or slots, 1060 at a proximal end of the discharge passage 1056, near the compression mechanism 1018 and through an aperture at a distal end of the discharge passage 1056, near the partition 1025.

The first bearing support member 1048 includes a first cylindrical surface 1068 and a second cylindrical surface 1072. The first cylindrical surface 1068 may support a first bearing 1076 and may define a first rotational axis A1. The second cylindrical surface 1072 is eccentric relative to the first cylindrical surface 1068 and defines a second rotational axis A2 that is parallel to and laterally offset from (i.e., non-collinear with) the first rotational axis A1. The second cylindrical surface 1072 supports a second bearing 1080.

The first and second bearings 1076, 1080 may be rolling element bearings that each may include an outer ring 1084, an inner ring 1088, and a plurality of rolling elements (e.g., spheres or cylinders) 1092 disposed between the outer and inner rings 1084, 1088. The inner ring 1088 of the first bearing 1076 may be fixedly attached to the first cylindrical surface 1068 of the first bearing support member 1048. The outer ring 1084 of the first bearing 1076 may be attached to the second bearing support member 1052. The inner ring 1088 of the second bearing 1080 may be fixedly attached to the second cylindrical surface 1072 of the first bearing support member 1048. The outer ring 1084 of the second bearing 1080 may be attached to the compression mechanism 1018 (as will be described in more detail below).

Alternatively, the second bearing 1080 may be attached to the first bearing support member 1048 or the compression mechanism 1018 to provide radial compliance. Radial compliance would allow the second bearing 1080 to separate sideways from the first bearing support member 1048 or the compression mechanism 1018, which may allow debris to pass through and improve durability and reliability.

The second bearing support member 1052 may be an annular member having a first cavity 1096 and a second cavity 1100. The first cavity 1096 may receive the first bearing 1076. The second cavity 1100 may receive a portion of the compression mechanism 1018 and the second bearing 1080. The second bearing support member 1052 may include a plurality of slots 1104 (FIG. 14). For example, the slots 1104 may be formed in an axially facing surface 1108 (i.e., a surface that faces a direction parallel to the direction in which axes A1, A2 extend) of the second bearing support member 1052.

An annular seal 1116 sealingly engages the second bearing support member 1052 and a second scroll member 1120. Seal 1116 may be disposed within a groove 1117 formed in the second bearing support member 1052 and may sealingly and slidably engage the second scroll member 1120 to form an annular biasing chamber 1118. The seal 1116 keeps the biasing chamber 1118 sealed off from the internal space 1033 (at discharge pressure) and the discharge fluid while still allowing relative movement between the second bearing support member 1052 and the second scroll member 1120.

The first end cap 1024 may include a second bearing housing 1124 formed integrally and monolithically therewith. The second bearing housing 1124 may include an annular central hub 1128. The hub 1128 may project from an internal surface 1132 of the first end cap 1024. The hub 1128 may define a suction-pressure chamber 1134. The hub 1128 receives a third bearing 1136. The hub 1128 may also include a central aperture 1140. The hub 1128 may separate the suction-pressure chamber 1134 from an internal space 1033 defined by the shell 1022.

The third bearing 1136 may be a rolling element bearing that may include an outer ring 1148, an inner ring 1152, and a plurality of rolling elements (e.g., spheres or cylinders) 1156 disposed between the outer and inner rings 1148, 1152. The inner ring 1148 may be fixedly attached to a cylindrical surface 1160 of a driveshaft 1164. The outer ring 1148 may be attached to the hub 1128.

An annular seal 1166 may be disposed within the hub 1128. The seal 1166 may sealingly engage the cylindrical surface 1160 and the hub 1128. The seal 1166 is press-fitted within the hub 1128. In this way, fluid is prevented from flowing to internal space 1033 (at discharge pressure).

The compression mechanism 1018 may include the driveshaft 1164. The compression mechanism 1018 may be disposed within the internal space 1033 in fluid communication with the suction-pressure chamber 1134. The compression mechanism 1018 may include a first compression member and a second compression member that cooperate to define fluid pockets (i.e., compression pockets) therebetween. For example, the compression mechanism 1018 may be a co-rotating scroll compression mechanism in which the first compression member is a first scroll member (i.e., a driver scroll member) 1168 and the second compression member is the second scroll member (i.e., a driven scroll member) 1120.

The driveshaft 1164 may include a shaft section 1172 and a hub 1176. The shaft section 1172 may include a suction passage 1180. The suction passage 1180 provides fluid communication between the suction gas inlet fitting 1032 and the compression mechanism 1018. An inlet 1184 of the suction passage 1180 may be disposed at or near a first end 1188 of the shaft section 1172 adjacent the suction gas inlet fitting 1032 or the suction-pressure chamber 1134. An outlet 1192 of the suction passage 1180 may be disposed at or near a second end 1196 of the shaft section 1172 adjacent to the compression mechanism 1018. The second end 1196 of the shaft section 1172 may include a flange 1200 for engaging the shaft section 1172 with the hub 1176. The suction passage 1180 may be coated in a thermal insulation coating to prevent preheat of the working fluid. For example, the thermal insulation coating may include, but is not limited to, ceramics, silicone or thermal insulating sprays.

A radial portion 1204 of the hub 1176 may engage with the second end 1196 of the shaft section 1172. More particularly, the flange 1200 on the second end 1196 of the shaft section 1172 may be fixed to the radial portion 1204 of the hub 1176. The hub 1176 may further include an axial portion 1212 and a flange 1216. The radial portion 1204 extends in a radial direction from the second end 1196 of the shaft section 1172 (in a direction perpendicular to a rotational axis A1 of driveshaft 1164) and the axial portion 1212 extends in an axial direction from a periphery of the radial portion 1204 (in a direction parallel to a rotational axis A1 of driveshaft 1164). The flange 1216 extends in a radial direction from an end of the axial portion 1212 and includes a plurality of pin housings 1220. As shown in FIG. 14, the pin housings 1220 are spaced apart from each other and are circumferentially disposed around the flange 1216. Each pin 1224 extends from a respective pin housing 1220 to the main bearing housing 1038, thereby coupling the main bearing housing 1038 and the hub 1176 to each other. In this manner, rotation of the main bearing housing 1038 causes corresponding rotation of the driveshaft 1164 about the rotational axis A1 of the driveshaft 1164.

The first scroll member 1168 may include a first end plate 1228 and a first spiral wrap 1232 extending from the first end plate 1228. The first end plate 1228 is disposed within and fixed to the flange 1216 of the driveshaft 1164 such that the flange 1216 surrounds the first spiral wrap 1232. In some configurations, the first scroll member 1168 and the driveshaft 1164 may be a single component as opposed to two separate components fixed to each other. The first end plate 1228 may include an axially extending passage 1236 (FIG. 14). A radially extending passage 1240 is formed between the first end plate 1228 and the hub 1176 and extends from the outlet 1192 of the suction passage 1180 to the axially extending passage 1236. The axially extending passage 1236 extends from an end of the radially extending passage 1240 to a suction inlet 1244 of the first scroll member 1168. In this way, suction gas flowing through the suction passage 1180 may flow through the passages 1236, 1240 and into an outermost pocket of the fluid pockets via the suction inlet 1244.

The second scroll member 1120 defines a second rotational axis A2 that is parallel to the rotational axis A1 and offset from the rotational axis A1. The second scroll member 1120 may include a second end plate 1248, a cylindrical hub 1252 extending from one side of the second end plate 1248, and a second spiral wrap 1256 extending from the opposite side of the second end plate 1248.

The first bearing support member 1048 may form a stationary crank shaft having the discharge passage 1056. The proximal end of the first bearing support member 1048 may extend through the bearing 1080 and into the hub 1252. The passage 1056 provides fluid communication between the compression mechanism 1018 and the discharge-pressure chamber 1034. The discharge passage 1056 may be coated with a thermal insulation coating to prevent heat transfer from the compressed working fluid to the compressor parts. For example, the thermal insulation coating may include, but is not limited to, ceramics, silicone or thermal insulating sprays.

The first and second spiral wraps 1232, 1256 are intermeshed with each other and cooperate to form a plurality of fluid pockets (i.e., compression pockets) therebetween. Rotation of the first scroll member 1168 about the rotational axis A1 and rotation of the second scroll member 1120 about the second rotational axis A2 causes the fluid pockets to decrease in size as they move from a radially outer position to a radially inner position, thereby compressing the working fluid therein from the suction pressure to the discharge pressure.

The second end plate 1248 may be disposed axially between the first end plate 1228 and the main bearing housing 1038. The second end plate 1248 may include a biasing passage 1258 that provides fluid communication between an intermediate-pressure compression pocket and the biasing chamber 1118.

The second end plate 1248 may include a discharge passage 1260. The discharge passage 1260 extends through the second end plate 1248 and provides fluid communication between a radially innermost one of the fluid pockets and the discharge-gas-outlet fitting 1035 (via the passage 1056 in the first bearing support member 1048). A discharge valve (e.g., a reed valve or other check valve) may be disposed within or adjacent the discharge passage 1260 or at the proximal end of the first bearing support member 1048. The discharge valve allows working fluid to be discharged from the compression mechanism 1018 through the discharge passage 1260 and into the first bearing support member 1048 and prevents working fluid in the first bearing support member 1048 from flowing back into to the compression mechanism 1018. A main portion of the discharge gas flowing out of the discharge passage 1260 may flow through the passage 1056 of the first bearing support member 1048, into the discharge-pressure chamber 1034 and out of the compressor 1000 through the discharge-gas-outlet fitting 1035.

A portion of the discharge gas flowing out of the discharge passage 1260 may flow through the second bearing 1080, between the first bearing support member 1048 and the second bearing support member 1052, through the first bearing 1076, and into the internal space 1033. The discharge gas in the internal space 1033 may circulate through the motor assembly 1016 to cool the motor assembly 1016.

The motor assembly 1016 may be disposed within the internal space 1033 (at discharge pressure) and may include a motor stator 1264 and a rotor 1268. The motor stator 1264 may be attached to the shell 1022 (e.g., via press fit, staking, epoxy, glue, adhesive, and/or welding). The rotor 1268 may be attached to the second bearing support member 1052 (e.g., via press fit, staking, and/or welding). The second bearing support member 1052 may be driven by the rotor 1268 and may be supported by bearings 1076 and 1136 for rotation relative to the shell assembly 1012. The bearing 1076 may be fixed to the first bearing support member 1048 and the second bearing support member 1052. The third bearing 1136 may be fixed to the central hub 1128 and the driveshaft 1164. In some configurations, the motor assembly 1016 is a variable-speed motor. In other configurations, the motor assembly 1016 could be a multi-speed motor or a fixed-speed motor.

Attaching the motor stator 1264 to the shell 1022 and the rotor 1268 to the second bearing support member 1052 positions the motor assembly 1016 about the second bearing support member 1052, instead of about the driveshaft 1164. Placement of the motor assembly 1016 about the second bearing support member 1052 reduces the compressor 1000 footprint. The shaft section 1172 of the driveshaft 1164 may be reduced in length, reducing an overall length of the compressor 1000. A reduction in the footprint of the compressor 1000 reduces the thermal communication of the suction gas with other parts of the compressor 1000, reducing preheat.

Following the arrows in FIG. 13, during use, a working fluid enters the compressor 1000 through the suction gas inlet fitting 1032 in the first end cap 1024 of the compressor 1000 (Arrow A). The working fluid may include both a refrigerant and an oil (for example, an oil mist). Since the compressor 1000 is a sumpless compressor, the oil for heat transfer and lubrication of moving parts travels with the working fluid through the compressor 1000. For example, the refrigerant may include, but is not limited to, one or more of R410a, R290, R744, R32 R454b, R134a, 404A, 407A/C/F, 507, and R717. For example, the oil may include, but is not limited to, one or more of Mineral Oil, Alkyl Benzene, Polyol Ester, and Polyalkylene glycol, as a few examples.

The working fluid, at suction pressure, enters the suction-pressure chamber 1134 from the suction gas inlet fitting 1032. The suction-pressure working fluid is pulled into the suction passage 1180 within the driveshaft 1164 (Arrow B). The working fluid moves through the driveshaft 1164 towards the compression mechanism 1018. The working fluid travels through the output 1192 of the suction passage 1180 and into the radially extending passage 1240 defined by the space between the hub 1176 and the first end plate 1228 (Arrow C).

The working fluid is received in the axially extending passage 1236 from the radially extending passage 1240 (Arrow D). The axially extending passage 1236 provides an entrance into the suction inlet 1244 in the compression mechanism 1018. The working fluid is compressed within the pockets defined by the first spiral wrap 1232 of the first, driving scroll 1168 and the second spiral wrap 1256 of the second, driven scroll 1120 (Arrow E).

The compressed working fluid is discharged through the discharge passage 1260 in the second end plate 1248 of the second, driven scroll 1120 (Arrow F). The compressed working fluid is at a high-pressure (i.e., compression pressure, or a pressure higher than the suction pressure) and flows through the discharge passage 1056 in the first bearing support member 1048. A portion of the working fluid exits the discharge passage 1056 through the first series of apertures 1060 at the proximal end of the discharge passage 1056.

The portion of working fluid may travel through the second bearing 1080, between the first bearing support member 1048 and the second bearing support member 1052, and the first bearing 1076 and into the interior space 1033 (Arrow G). The portion of the working fluid in the internal space 1033 may circulate through the motor assembly 1016 to transfer heat away from the motor assembly 1016 and cool the rotor 1268 and stator 1264 (Arrow H).

The compressed working fluid in the discharge passage 1056 enters the discharge-pressure chamber 1034 (Arrow J). The compressed fluid circulates within the discharge-pressure chamber 1034 (Arrow K). Apertures 1031 in the partition 1025 provide fluid communication between the discharge-pressure chamber 1034 and the interior space 1033 (Arrow L). Compressed working fluid may flow from the discharge-pressure chamber 1034 to circulate through the motor assembly 1016, as previously described. Compressed working fluid from the motor assembly 1016 in the interior space 1033 may flow into the discharge-pressure chamber 1034 to exit the compressor 1000 through the discharge gas outlet fitting 1035 (Arrow M).

In an alternative example, the compressor 1000 may include an impeller (not shown), similar to impeller 204 in compressor 200, disposed between the flange 1216 and the first end plate 1228 of the first scroll member 1168, which defines the suction plenum. The impeller may define a passage, similar to the radially extending passage 1240, which extends from the output 1192 to the axially extending passage 1236, to streamline the gas flow from the output 1192 to the axially extending passage 1236. The streamlined flow may reduce pressure drops between the output 1192 and the compression mechanism 1018. Additionally, the impeller provides pre-compression of the working fluid, where the working fluid is dynamically compressed prior to the compression mechanism 1018 utilizing a centrifugal effect. The streamlined flow may, in certain conditions, provide a supercharging effect.

As described with respect to impeller 204, the impeller may be formed of a thermally insulated material. For example, the thermally insulated material may include, but is not limited to, ceramics, silicone, thermal insulating sprays, plastics, ceramics, or graphite. The thermally insulating impeller may reduce the heat transfer into the refrigerant flowing through the passage in the impeller toward the axially extending passage 1236 and compression mechanism 1018. Reduction in the heat transfer may improve the volumetric efficiency of the refrigerant.

The impeller may be formed integrally with the first end plate 1228 of the first scroll member 1168 to create a single, monolithic piece. Accordingly, the position of the impeller relative to the first scroll member 1168 may be fixed. Further, forming the impeller with the first end plate 1228 creates easier and more reliable assembly of the compressor 1000. Alternatively, the impeller may fit within a recessed portion in the first end plate 1228 of the first scroll member 1168. The recessed portion may locate and fix the position of the impeller relative to the flange 1216 and the first scroll member 1168. Alternatively, the impeller may be formed integrally with the hub 1176 or with the driveshaft 1164.

During compressor 1000 operation, the working fluid, at suction pressure, moves through the driveshaft 1164 towards the compression mechanism 1018. The working fluid travels through an output 1192 of the suction passage 1180 and into the passage defined by the impeller. The working fluid is received in the axially extending passage 1236 from the passage defined by the impeller. The working fluid is compressed within the pockets defined by the first spiral wrap 1232 of the first driving scroll 1168 and the second spiral wrap 1256 of the second, driven scroll 1120.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compression mechanism configured to compress a fluid from a suction pressure to a discharge pressure;

a driveshaft engaged with the compression mechanism and fixed to rotate with at least a portion of the compression mechanism;

a motor configured to rotate the driveshaft; and a shell assembly defining a suction chamber, wherein the compression mechanism, the driveshaft, and the motor are disposed within the shell assembly, and wherein the fluid at the suction pressure in the suction chamber circulates through the motor and is configured to transfer heat away from the motor, wherein the driveshaft includes a longitudinal aperture configured to receive the fluid at the suction pressure, and the driveshaft includes a flange that receives at least a portion of the compression mechanism, the flange and the compression mechanism defining a fluid passage therebetween, the fluid at the suction pressure being received within the fluid passage from the longitudinal aperture in the driveshaft.

2. The compressor of claim 1, wherein:

the shell assembly includes a shell body, an endcap, and a partition, the shell body defines the suction chamber, the endcap and the partition define a discharge-pressure chamber.

3. The compressor of claim 1, further comprising:

a shaft engaged with the compression mechanism and fixed in a stationary position, wherein the shaft includes a longitudinal discharge aperture, and the longitudinal discharge aperture is in fluid communication with a discharge port of the compression mechanism.

4. The compressor of claim 3, further comprising a bearing housing fixed to rotate with at least a portion of the compression mechanism, wherein the shaft is supported within the bearing housing by a first bearing, and the shaft is supported within the compression mechanism by a second bearing.

5. The compressor of claim 4, further comprising:

a first seal engaged with the shaft and the bearing housing and configured to prevent flow of fluid from the compression mechanism or an interface between the discharge port and the longitudinal discharge aperture.

6. The compressor of claim 4, wherein the motor is fixed radially outside of the bearing housing.

7. The compressor of claim 3, wherein:

the shell assembly is configured to house the compression mechanism, the driveshaft, and the motor, the shell assembly includes a shell body, an endcap, and a partition, and the shaft is fixed to or integral with the endcap.

8. The compressor of claim 3, wherein:

the shell assembly is configured to house the compression mechanism, the driveshaft, and the motor, the shell assembly includes a shell body, an endcap, and a partition, and the shaft is fixed to or integral with the partition.

9. The compressor of claim 1, wherein the compression mechanism includes a first scroll and a second scroll, the first scroll being fixed for rotation with the flange, and the first scroll including an axial passage in fluid communication with the fluid passage between the compression mechanism and the flange.

10. The compressor of claim 1, wherein the driveshaft is supported by a bearing on a proximal end and engaged with the compression mechanism on a distal end.

11. The compressor of claim 10, further comprising:

a seal engaged with the driveshaft and the bearing and configured to prevent flow of fluid from a suction-pressure inlet or an interface between the suction-pressure inlet and the driveshaft.

12. The compressor of claim 1, wherein the compression mechanism includes an impeller that cooperates with the flange to define the fluid passage.

13. The compressor of claim 12, wherein the impeller is formed with an end plate of a scroll member of the compression mechanism as a single, monolithic part.

14. A compressor comprising:

a shell assembly having a shell body, a first end cap, a second end cap, and a partition, wherein the shell assembly defines a discharge-pressure chamber and an internal space at a discharge pressure;

a compression mechanism housed within the shell assembly and configured to compress a fluid to the discharge pressure;

a bearing housing assembly having a bearing housing and a bearing, the bearing housing fixed to rotate with at least a portion of the compression mechanism;

a driveshaft housed within the shell assembly, engaged with the compression mechanism, and fixed to rotate with at least a portion of the compression mechanism; and a motor housed within the shell assembly and configured to rotate the driveshaft, wherein the driveshaft includes a longitudinal aperture configured to receive the fluid at a suction pressure, wherein the shell body, the first end cap, and the partition define the internal space, wherein the compression mechanism, the bearing housing assembly and the motor are housed in the internal space, wherein the partition includes an aperture through which the fluid at the discharge pressure flows from the discharge-pressure chamber to the internal space, and wherein the partition is disposed between the second end cap and first and second scrolls of the compression mechanism.

15. A compressor comprising:

a shell assembly having a shell body, an end cap, and a partition;

a compression mechanism housed within the shell assembly and configured to compress a fluid to a discharge pressure;

a driveshaft housed within the shell assembly, engaged with the compression mechanism, and fixed to rotate with at least a portion of the compression mechanism;

a bearing supporting the driveshaft; and a motor housed within the shell assembly and configured to rotate the driveshaft, wherein the driveshaft includes a longitudinal aperture configured to receive the fluid at a suction pressure, wherein the compression mechanism and the motor are housed in a suction-pressure chamber defined by the shell assembly, wherein the shell body, the end cap, and the partition define the suction-pressure chamber, wherein a suction gas inlet fitting is attached to the shell assembly and is configured to provide a first portion of the fluid at the suction pressure to the longitudinal aperture, and wherein a second portion of the fluid at the suction pressure flows from the suction gas inlet fitting to the suction-pressure chamber through a flow path that extends through the bearing and radially outside of the longitudinal aperture.

* * * * *